US010746444B2

(12) United States Patent
Kim

(10) Patent No.: US 10,746,444 B2
(45) Date of Patent: Aug. 18, 2020

(54) REFRIGERATOR

(71) Applicant: LG ELECTRONICS INC., Seoul (KR)

(72) Inventor: Hosan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 246 days.

(21) Appl. No.: 15/196,282

(22) Filed: Jun. 29, 2016

(65) Prior Publication Data

US 2017/0030615 A1 Feb. 2, 2017

(30) Foreign Application Priority Data

Jul. 28, 2015 (KR) ..... 10-2015-0106880

(51) Int. Cl.
*F25B 47/02* (2006.01)
*F25D 11/02* (2006.01)
*F25D 21/12* (2006.01)

(52) U.S. Cl.
CPC ..... *F25B 47/022* (2013.01); *F25D 11/022* (2013.01); *F25D 21/12* (2013.01); *F25B 2347/021* (2013.01); *F25D 2321/1412* (2013.01)

(58) Field of Classification Search
CPC ..... F25D 11/022; F25D 21/06; F25D 21/12; F25D 2321/1412; F25B 47/022; F25B 2313/02742; F25B 2347/021; F25B 2347/022; F25B 47/02; F25B 47/025
See application file for complete search history.

(56) References Cited

U.S. PATENT DOCUMENTS 4,741,171 A 5/1988 Toshiyuki
2007/0199335 A1* 8/2007 Innes ..... F25B 47/022 62/151

(Continued)

FOREIGN PATENT DOCUMENTS

| | | |
|---|---|---|
| CA | 2530567 | 12/2005 |
| JP | H05296615 | 9/1993 |
| KR | 20100045199 | 5/2010 |

(Continued)

OTHER PUBLICATIONS

Extended European Search Report in European Application No. 16175406.4-1605, dated Dec. 21, 2016, 8 pages (with English translation).

(Continued)

*Primary Examiner* — Tavia Sullens
(74) *Attorney, Agent, or Firm* — Fish & Richardson P.C.

(57) ABSTRACT

A refrigerator includes a compressor configured to compress a refrigerant, a condenser configured to condense the refrigerant compressed in the compressor, an expander configured to depressurize the refrigerant condensed in the condenser, a plurality of evaporators configured to evaporate the refrigerant depressurized in the expander, a first valve configured to be operated to introduce the refrigerant into at least one of the plurality of evaporators, a hot gas valve device disposed at an inlet side of the first valve and configured to guide the refrigerant passed through the compressor or the condenser to the plurality of evaporators, and a hot gas path configured to extend from the hot gas valve device to the plurality of evaporators.

5 Claims, 21 Drawing Sheets

(56) References Cited

U.S. PATENT DOCUMENTS

| | | | | |
|---|---|---|---|---|
| 2012/0023975 | A1* | 2/2012 | Yoon | F25D 11/022 62/81 |
| 2015/0184926 | A1 | 7/2015 | Yun | |

FOREIGN PATENT DOCUMENTS

| | | |
|---|---|---|
| KR | 20130081382 | 7/2013 |
| KR | 101859231 | 5/2018 |

OTHER PUBLICATIONS

Notice of Allowance in European Application No. 16175406.4, dated Nov. 23, 2018, 6 pages.
Chinese Office Action in Chinese Application No. 201610465247, dated Aug. 12, 2019, 13 pages (with English translation).

* cited by examiner

REFRIGERATOR

CROSS-REFERENCE TO RELATED APPLICATION(S)

This application claims priority under 35 U.S.C. § 119 and 35 U.S.C. § 365 to Korean Patent Application No. 10-2015-0106880, filed in Korea on Jul. 28, 2015, whose entire disclosure is hereby incorporated by reference.

FIELD

The present disclosure relates to a refrigerator.

BACKGROUND

Generally, a refrigerator has a plurality of storage compartments that can accommodate stored goods and keep food refrigerated or frozen. Additionally, one surface of each of the storage compartments is formed to be opened, such that the food can be put in or taken out therethrough. The plurality of storage compartments may include a freezer compartment in which the food is kept frozen and a refrigerator compartment in which the food is kept refrigerated.

A refrigeration system in which a refrigerant is circulated is typically provided in the refrigerator. The refrigeration system may include a compressor, a condenser, an expander, and an evaporator. The evaporator may include a first evaporator installed at a side of the refrigerator compartment and a second evaporator installed at a side of the freezer compartment. Cooling air stored in the refrigerator compartment can be cooled while passing through the first evaporator, and then supplied again into the refrigerator compartment. Furthermore, cooling air stored in the freezer compartment can be cooled while passing through the second evaporator, and then supplied again into the freezer compartment.

In some cases, a refrigerator may further include a defrosting heater that is provided to remove frost formed on the evaporator. When an amount of the frost formed on the evaporator is increased, there may be a problem that heat exchange efficiency of the evaporator may be lowered. Therefore, when it is recognized that the amount of the frost formed on the evaporator is increased, the defrosting heater can be driven to perform a defrosting operation. When the defrosting operation is performed, a predetermined calorific value may be provided to the evaporator, and thus the frost formed on the evaporator may be removed. In some cases, the defrosting time may be determined by detecting a surface temperature of an evaporator before operating the defrosting heater.

SUMMARY

According to one aspect, a refrigerator includes a compressor configured to compress a refrigerant, a condenser configured to condense the refrigerant compressed in the compressor, an expander configured to depressurize the refrigerant condensed in the condenser, a plurality of evaporators configured to evaporate the refrigerant depressurized in the expander, a first valve configured to be operated to introduce the refrigerant into at least one of the plurality of evaporators, a hot gas valve device disposed at an inlet side of the first valve and configured to guide the refrigerant passed through the compressor or the condenser to the plurality of evaporators, and a hot gas path configured to extend from the hot gas valve device to the plurality of evaporators.

Implementations according to this aspect may include one or more of the following features. For example, at least one of the plurality of evaporators may include a first pipe configured to communicate the refrigerant passed through the first valve, and a second pipe configured to communicate the refrigerant in the hot gas path. The hot gas valve device may include a second valve that is disposed at an inlet side or an outlet side of the condenser, and a third valve that is disposed at an outlet side of the second valve. In some cases, the hot gas path may include a first hot gas path that extends from the second valve to a first evaporator of the plurality of evaporators, and a second hot gas path that extends from the third valve to a second evaporator of the plurality of evaporators. The second valve or the third valve may include a four-way valve having four inlet and outlet parts. The four inlet and outlet parts may include a first inlet and outlet part that is connected to an inlet side of the second valve or the third valve, a second inlet and outlet part that is connected to an outlet side of the second valve or the third valve, and third and fourth inlet and outlet parts that are connected to the first hot gas path or the second hot gas path. The fourth inlet and outlet part may include an inlet and outlet part that is configured to discharge the refrigerant to a particular evaporator of the plurality of evaporators, and the third inlet and outlet part may include an inlet and outlet part that is configured to introduce the refrigerant passed through the particular evaporator.

In some implementations, the hot gas path, the hot gas valve device, and one of the plurality of evaporators may form a closed loop that is configured to accommodate a flow of the refrigerant. In some cases, the refrigerator may further include a plurality of refrigerant paths which extend from the first valve to the plurality of evaporators, wherein the expander may be installed at each of the plurality of refrigerant paths. Based on the refrigerator being operated in a first mode operation, the first valve may be operated such that the refrigerant flows to at least one of the plurality of evaporators, and the hot gas valve device may be operated to restrict a flow of the refrigerant to the hot gas path. Based on the refrigerator being operated in a second mode operation, the first valve may be operated such that the refrigerant flows to the first evaporator, and the second valve may be operated to restrict a flow of the refrigerant to the first hot gas path, and the third valve is operated to guide the flow of the refrigerant to the second hot gas path. Based on the refrigerator being operated in a third mode operation, the first valve may be operated such that the refrigerant flows to the second evaporator, and the second valve is operated to guide a flow of the refrigerant to the first hot gas path, and the third valve may be operated to restrict the flow of the refrigerant to the second hot gas path. The compressor may include a first compressor that is positioned to receive the refrigerant at a first pressure, and a second compressor that is positioned to receive the refrigerant at a second pressure that is higher than the first pressure, the second compressor being installed at an outlet side of the first compressor. The evaporator may include a first evaporator configured to cool a refrigerator compartment and a second evaporator configured to cool a freezer compartment. Moreover, the refrigerant passed through the second evaporator may be primarily compressed in the first compressor, and the primarily compressed refrigerant may be combined with the refrigerant passed through the first evaporator and suctioned into the second compressor. In some cases, the hot gas path may extend to the second evaporator, and defrosting of the second evaporator may be performed by the refrigerant flowing through the hot gas path.

BRIEF DESCRIPTION OF THE DRAWINGS

Implementations will be described in detail with reference to the following drawings in which like reference numerals refer to like elements, and wherein.

DETAILED DESCRIPTION

Figure 1:
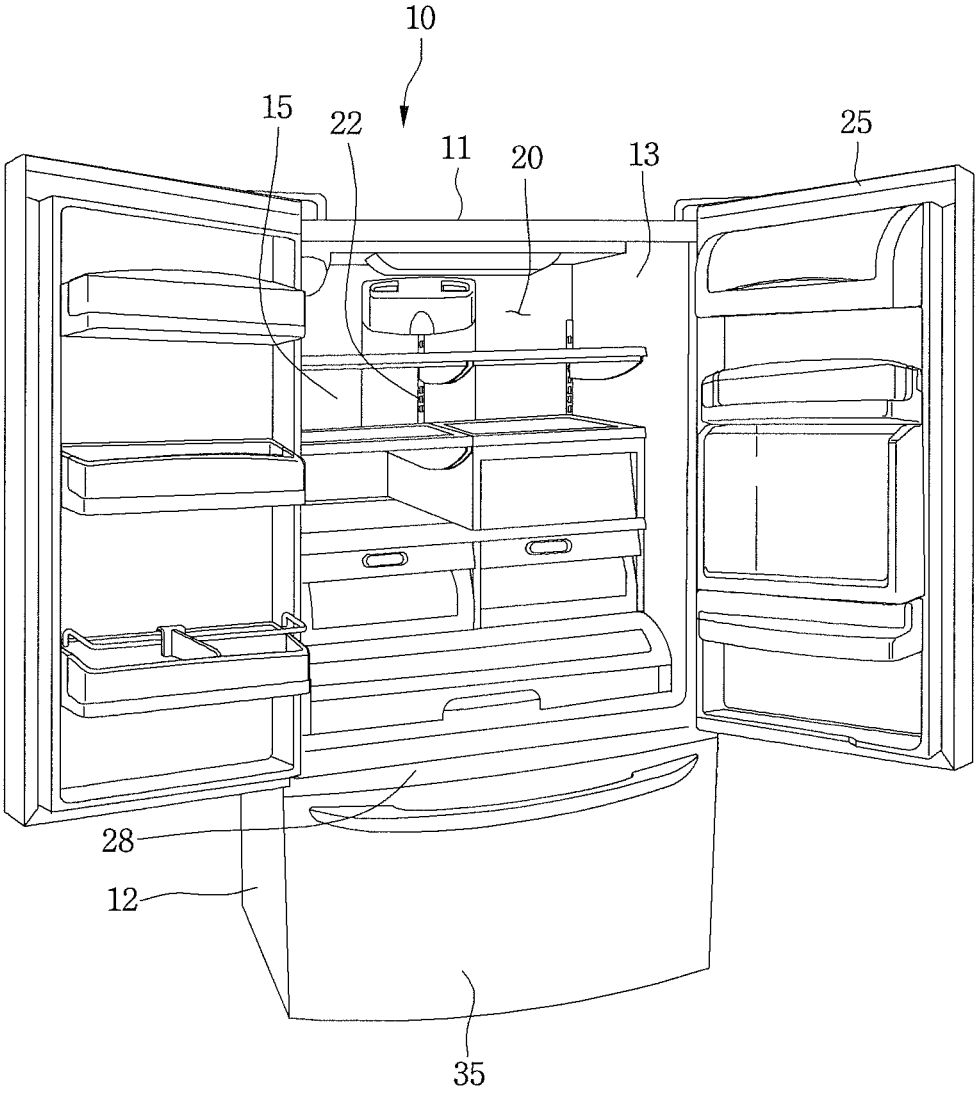
FIG. 1 is a perspective view of an example refrigerator according to an implementation.

Referring to FIGS. 1 to 4, a refrigerator 10 according to an implementation of the present disclosure includes a cabinet 11 which forms a storage compartment. The storage compartment may include a refrigerator compartment 20 and a freezer compartment 30. As shown, the refrigerator compartment 20 may be disposed at an upper side of the freezer compartment 30. However, positions of the refrigerator compartment 20 and the freezer compartment 30 are not limited thereto and may be arranged in varying configurations. The refrigerator compartment 20 and the freezer compartment 30 may be divided by a partition wall 28.

The refrigerator 10 may include a refrigerator compartment door 25 which opens and closes the refrigerator compartment 20 and a freezer compartment door 35 which opens and closes the freezer compartment 30. The refrigerator compartment door 25 may be hinge-coupled to a front of the cabinet 11 and may be designed to be rotatable, and the freezer compartment door 35 may be a drawer type that can be withdrawn forward.

Based on the cabinet 11 shown in FIG. 1, for improved clarity, the side at which the refrigerator compartment door 25 is located is referred to herein as a "front side," the opposite side thereof is referred to as a "rear side," and the side at which either side surface of the cabinet 11 is located is referred to as a "lateral side."

As shown, the cabinet 11 includes an outer case 12 to define an exterior of the refrigerator 10, and an inner case 13 that is disposed inside the outer case 12 to define at least a part of an inner surface of the refrigerator compartment 20 or the freezer compartment 30. The inner case 13 may include a refrigerator compartment side inner case that forms the inner surface of the refrigerator compartment 20, and a freezer compartment side inner case that forms the inner surface of the freezer compartment 30.

A panel 15 may be provided at a rear surface of the refrigerator compartment 20. The panel 15 may be installed at a position that is spaced forward from a rear of the refrigerator compartment side inner case. A refrigerator compartment cooling air discharge part 22 for discharging cooling air to the refrigerator compartment 20 may be provided at the panel 15. For example, the refrigerator compartment cooling air discharge part 22 may be in the form of a duct, and may be disposed to be coupled to an approximately central portion of the panel 15.

In some cases, a freezer compartment side panel may be installed at a rear wall of the freezer compartment 30, and a freezer compartment cooling air discharge part for discharging the cooling air to the freezer compartment 30 may be located at the freezer compartment side panel.

An installation space in which a first evaporator 110 is installed may be formed at a space between the panel 15 and a rear of the inner case 13. An installation space in which a second evaporator 150 is installed may be formed at a space between the panel and a rear of the freezer compartment side inner case.

The refrigerator 10 may include a plurality of evaporators 110 and 150 which cool the refrigerator compartment 20 and the freezer compartment 30, respectively. The plurality of evaporators 110 and 150 may include the first evaporator 110 which cools the refrigerator compartment 20, and the second evaporator 150 which cools the freezer compartment 30. The first evaporator 110 may be referred to as a "refrigerator compartment evaporator," and the second evaporator 150 may be referred to as a "freezer compartment evaporator."

Figure 2:
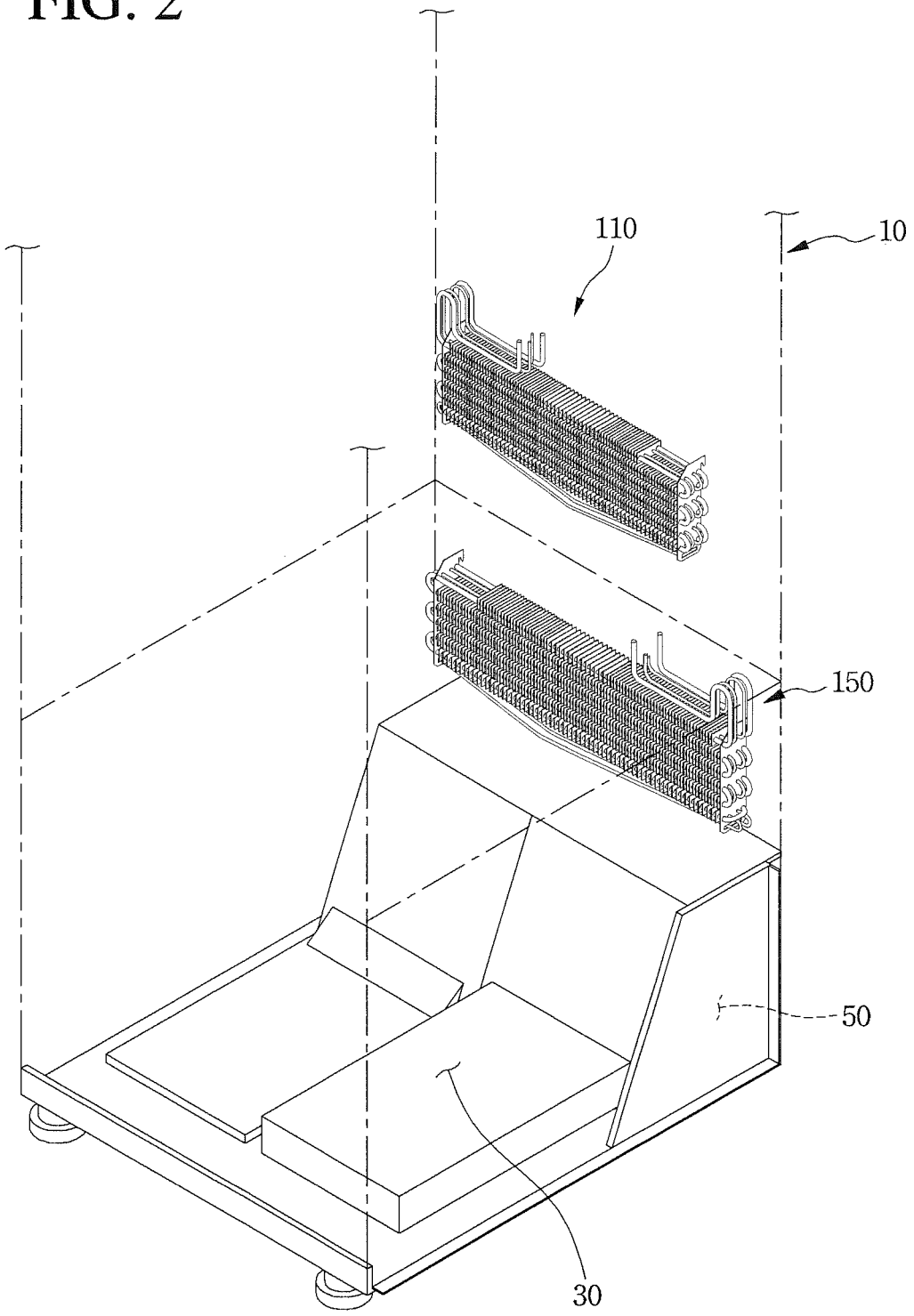
FIG. 2 is a partial perspective view of the refrigerator.
Figure 3:
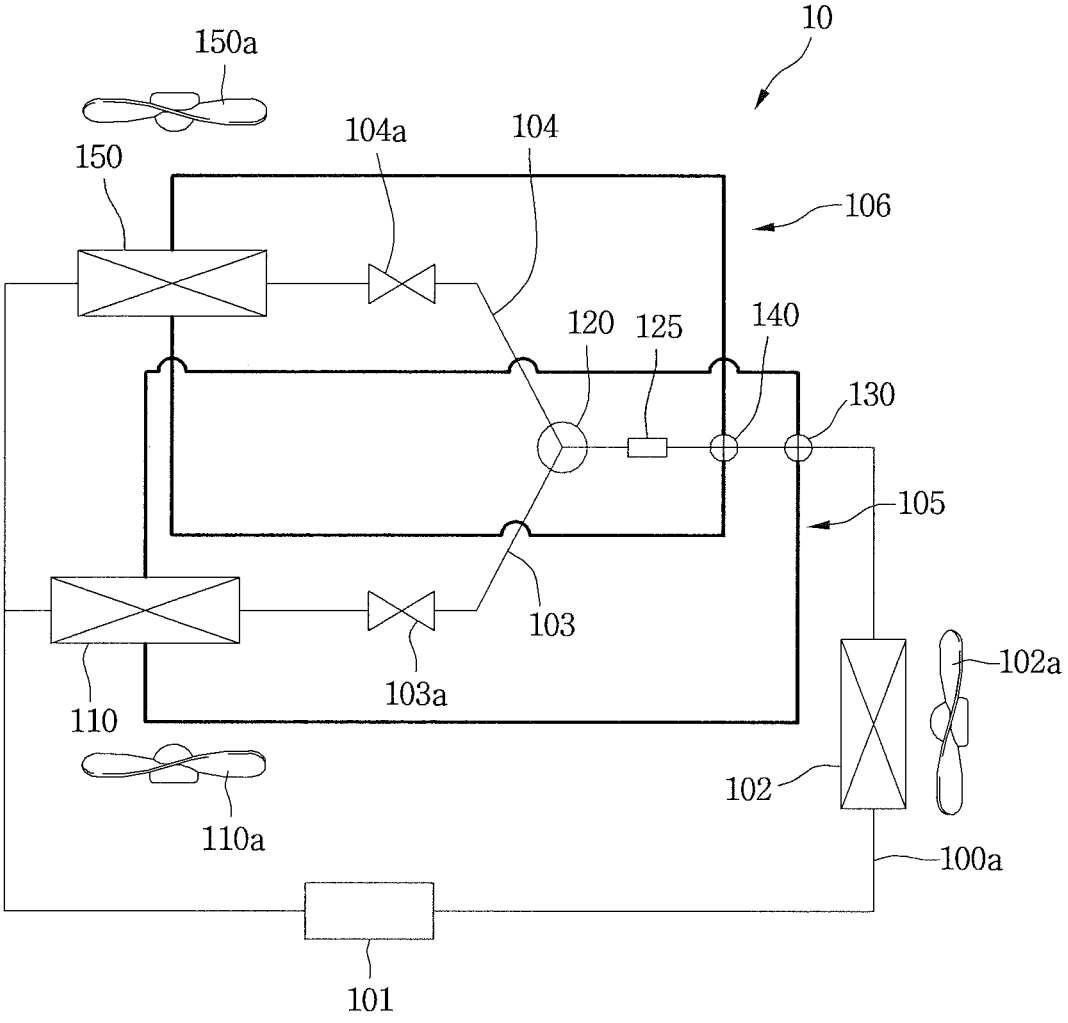
FIG. 3 is a cycle view illustrating an example configuration of the refrigerator.

The refrigerator compartment 20 may be disposed at an upper side of the freezer compartment 30, and as illustrated in FIG. 2, the first evaporator 110 may be disposed at an upper side of the second evaporator 150.

The first evaporator 110 may be disposed at a rear wall of the refrigerator compartment 20, i.e., a rear side of the panel 15, and the second evaporator 150 may be disposed at a rear wall of the freezer compartment 30, i.e., a rear side of the freezer compartment side panel. The cooling air generated at the first evaporator 110 may be supplied to the refrigerator compartment 20 through the refrigerator compartment cooling air discharge part 22, and the cooling air generated at the second evaporator 150 may be supplied to the freezer compartment 30 through the freezer compartment cooling air discharge part.

The first evaporator 110 and the second evaporator 150 may be hooked to the inner case 13. For example, the second evaporator 150 may include hooks 162 and 167 (referring to FIG. 11) that are hooked to the inner case 13.

The refrigerator 10 may include a plurality of devices for driving the refrigeration cycle. Specifically, the refrigerator 10 may include a compressor 101 that compresses a refrigerant, a condenser 102 that condenses the refrigerant compressed in the compressor 101, a plurality of expanders 103*a* and 104*a* that depressurize the refrigerant condensed in the condenser 102, and the plurality of evaporators 110 and 150 that evaporate the refrigerant depressurized in the plurality of expanders 103*a* and 104*a*.

The refrigerator 10 may further include a refrigerant pipe 100*a*, which connects the compressor 101, the condenser 102, the expanders 103*a* and 104*a*, and the evaporators 110 and 150, and which guides a flow of the refrigerant.

The plurality of evaporators 110 and 150 may include the first evaporator 110 for generating the cooling air which will be supplied to the refrigerator compartment 20, and the second evaporator 150 for generating the cooling air which will be supplied to the freezer compartment 30. The first evaporator 110 may be disposed at one side of the refrigerator compartment 20, and the second evaporator 150 may be disposed at one side of the freezer compartment 30. The first and second evaporators 110 and 150 may be connected in parallel with each other.

A temperature of the cooling air supplied to the freezer compartment 30 may be lower than that of the cooling air supplied to the refrigerator compartment 20, and thus a refrigerant evaporation pressure of the second evaporator 150 may be lower than that of the first evaporator 110. The refrigerant evaporated in the first evaporator 110 and the second evaporator 150 may be combined, and then may be suctioned into the compressor 101.

The plurality of expanders 103*a* and 104*a* may include a first expander 103*a* for expanding the refrigerant which will be introduced into the first evaporator 110, and a second expander 104*a* for expanding the refrigerant which will be introduced into the second evaporator 150. Each of the first and second expanders 103*a* and 104*a* may include a capillary tube.

In order for the refrigerant evaporation pressure of the second evaporator 150 to be positioned lower than that of the first evaporator 110, a diameter of the capillary tube of the second expander 104*a* may be smaller than that of the capillary tube of the first expander 103*a*.

The refrigerator 10 may include a first refrigerant path 103 and a second refrigerant path 104 that are branched from the refrigerant pipe 100*a*. The first refrigerant path 103 may be connected to the first evaporator 110, and the second refrigerant path 104 may be connected to the second evaporator 150.

The first expander 103*a* may be installed at the first refrigerant path 103, and the second expander 104*a* may be installed at the second refrigerant path 104.

The refrigerator 10 further can further include a first valve 120 through which the refrigerant is branched and introduced to the first and second refrigerant paths 103 and 104. The first valve 120 may a device that controls a flow of the refrigerant so that the first and second evaporators 110 and 150 are operated simultaneously or separately, that is, the refrigerant may be introduced into at least one of the first evaporator 110 and the second evaporator 150. The first valve 120 can be a three-way valve having one inlet part through which the refrigerant is introduced and two outlet parts through which the refrigerant is discharged.

The first and second refrigerant paths 103 and 104 are connected to the two outlet parts of the first valve 120, respectively. For example, in one operation mode of the refrigerator 10, the refrigerant passed through the first valve 120 may be branched to the first and second refrigerant paths 103 and 104, and then may be discharged. The outlet parts connected to the first and second refrigerant paths 103 and 104 are referred, in turn, to as a "first outlet part" and a "second outlet part."

As another example, in another operation mode of the refrigerator 10, the refrigerant passed through the first valve 120 may flow to the first refrigerant path 103, and may be restricted from flowing to the second refrigerant path 104.

As still another example, in still another operation mode of the refrigerator 10, the refrigerant passed through the first valve 120 may flow to the second refrigerant path 104, and may be restricted from flowing to the first refrigerant path 103.

The refrigerator 10 further may further include a first hot gas path 105 that is coupled to the first evaporator 110 to supply the refrigerant condensed in the condenser 102 to the first evaporator 110, and a second valve 130 that is controlled to selectively supply the condensed refrigerant to the first evaporator 110. For example, the second valve 130 may include a four-way valve having four inlet and outlet parts.

The second valve 130 may be installed at the refrigerant pipe 100*a* located at an outlet side of the condenser 102, and the first hot gas path 105 may be connected from a fourth inlet and outlet part 134 (referring to FIGS. 4A and 4B) of the second valve 130 to a third inlet and outlet part 133 of the second valve 130 via the first evaporator 110. That is, the first hot gas path 105 may form a closed loop which passes through the second valve 130 and the first evaporator 110.

The refrigerator 10 can further include a second hot gas path 106 that is coupled to the second evaporator 150 to supply the refrigerant passed through the second valve 130 to the second evaporator 150, and a third valve 140 that is controlled to selectively supply the refrigerant to the second evaporator 150. For example, the third valve 140 includes a four-way valve having four inlet and outlet parts.

The first hot gas path 105 and the second hot gas path 106 serve to supply the high temperature refrigerant condensed in the condenser 102 to the first evaporator 110 and the second evaporator 150, respectively, and thus may be referred to as "hot gas paths."

The first valve 120 is a valve device that branches the refrigerant to the plurality of evaporators 110 and 150, and thus may be referred to as an "evaporator inlet valve device." The second and third valves 130 and 140 are valve devices which guide the refrigerant to the first hot gas path 105 or the second hot gas path 106, and may be referred to as "hot gas valve devices."

The third valve 140 is installed at the refrigerant pipe 100*a* located at an outlet side of the second valve 130, and the second hot gas path 106 may be connected from a fourth inlet and outlet part 144 (referring to FIGS. 4A and 4B) of the third valve 140 to a third inlet and outlet part 143 of the third valve 140 via the second evaporator 150. That is, the second hot gas path 106 may form a closed loop which passes through the third valve 140 and the second evaporator 150.

An operation mode of the second valve 130 or the third valve 140 may be determined according to an operation mode of the refrigerator 10, and whether the refrigerant flows through the first hot gas path 105 or the second hot gas path 106 may be determined based on the operation mode of the second valve 130 or the third valve 140. Detailed description thereof will be provided later with reference to FIGS. 5 to 10.

An outlet side pipe of the third valve 140 may be connected to the first valve 120. And a dryer 125 which filters water or foreign substances in the refrigerant may be installed at the outlet side pipe of the third valve 140. That is, the dryer 125 may be installed at a pipe which connects between the first valve 120 and the third valve 140.

The refrigerator 10 can further include fans 102*a*, 110*a* and 150*a* that are provided at one side of a heat exchanger to blow air. The fans 102*a*, 110*a* and 150*a* may include a condensation fan 102*a* that is provided at one side of the condenser 102, a first evaporation fan 110*a* that is provided at one side of the first evaporator 110, and a second evaporation fan 150*a* that is provided at one side of the second evaporator 150.

Heat exchange performance of each of the first and second evaporators 110 and 150 may be changed according to a rotating speed of each of the first and second evaporation fans 110*a* and 150*a*. For example, when a lot of cooling air is needed according to an operation of the first evaporator 110, the rotating speed of the first evaporation fan 110*a* may be increased, and when the cooling air is sufficient, the rotating speed of the first evaporation fan 110*a* may be reduced.

Figure 4A:
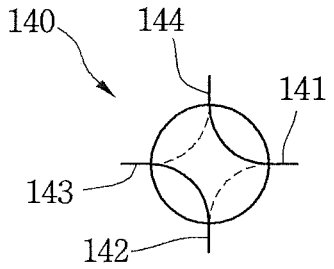
FIGS. 4A and 4B are schematic views illustrating example configurations of a second valve and a third valve.
Figure 4B:
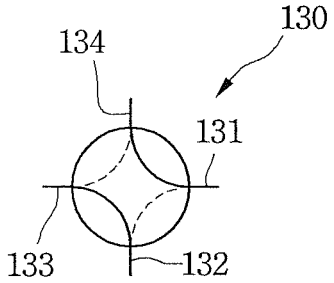

Referring to FIG. 4B, the second valve 130 includes four inlet and outlet parts 131, 132, 133, and 134. Specifically, the four inlet and outlet parts 131, 132, 133, and 134 include a first inlet and outlet part 131 that is connected to an outlet side pipe of the condenser 102, a second inlet and outlet part 132 that is connected to the third valve 140, the third inlet and outlet part 133 that is connected to the first hot gas path 105 and through which the refrigerant passed through the first evaporator 110 is introduced, and the fourth inlet and outlet part 134 that is connected to the first hot gas path 105 and through which the refrigerant to be introduced into the first evaporator 110 is discharged.

That is, for the first hot gas path 105, the third inlet and outlet part 133 of the second valve 130 may be connected to an outlet side pipe of the first evaporator 110, and the fourth inlet and outlet part 134 may be connected to an inlet side pipe of the first evaporator 110.

In a manufacturing process of the refrigerator 10, a plurality of cycle forming elements that form the refrigerator 10 may be set in a vacuum state. To this end, a communication state of each of the inlet and outlet parts of the second valve 130 may be set as illustrated in FIG. 4B.

Specifically, the first inlet and outlet part 131 may be in communication with the fourth inlet and outlet part 134, and the second inlet and outlet part 132 may be in communication with the third inlet and outlet part 133. In this case, the outlet side pipe of the condenser 102 is connected to the first hot gas path 105 through the first and fourth inlet and outlet parts 131 and 134 of the second valve 130, and connected to an outlet side pipe of the second valve 130 through the third and second inlet and outlet parts 133 and 132 of the second valve 130. The outlet side pipe of the second valve 130 is connected to the third valve 140. Such a set state of the second valve 130 is referred to herein as an "initial set state."

Referring to FIG. 4A, the third valve 140 includes four inlet and outlet parts 141, 142, 143, and 144. Specifically, the four inlet and outlet parts 141, 142, 143, and 144 include a first inlet and outlet part 141 that is connected to the second inlet and outlet part 132 of the second valve 130, i.e., the outlet side pipe of the second valve 130, and through which the refrigerant passed through the second valve 130 is introduced, a second inlet and outlet part 142 that is connected to an inlet side pipe of the first valve 120, the third inlet and outlet part 143 that is connected to the second hot gas path 106 and through which the refrigerant passed through the second evaporator 150 is introduced, and the fourth inlet and outlet part 144 that is connected to the second hot gas path 106 and through which the refrigerant to be introduced into the second evaporator 150 is discharged.

That is, for the second hot gas path 106, the third inlet and outlet part 143 of the third valve 140 may be connected to an outlet side pipe of the second evaporator 150, and the fourth inlet and outlet part 144 may be connected to an inlet side pipe of the second evaporator 150.

In the manufacturing process of the refrigerator 10, a communication state of each of the inlet and outlet parts of the third valve 140 may be set as illustrated in FIG. 4A.

Specifically, the first inlet and outlet part 141 may be in communication with the fourth inlet and outlet part 144, and the second inlet and outlet part 142 may be in communication with the third inlet and outlet part 143. In this case, the outlet side pipe of the second valve 130 is connected to the second hot gas path 106 through the first and fourth inlet and outlet parts 141 and 144 of the third valve 140, and connected to the outlet side pipe of the third valve 140 through the third and second inlet and outlet parts 143 and 142 of the third valve 140. The outlet side pipe of the third valve 140 is connected to the dryer 125. Such a set state of the third valve 140 is referred to herein as an "initial set state."

Figure 5:
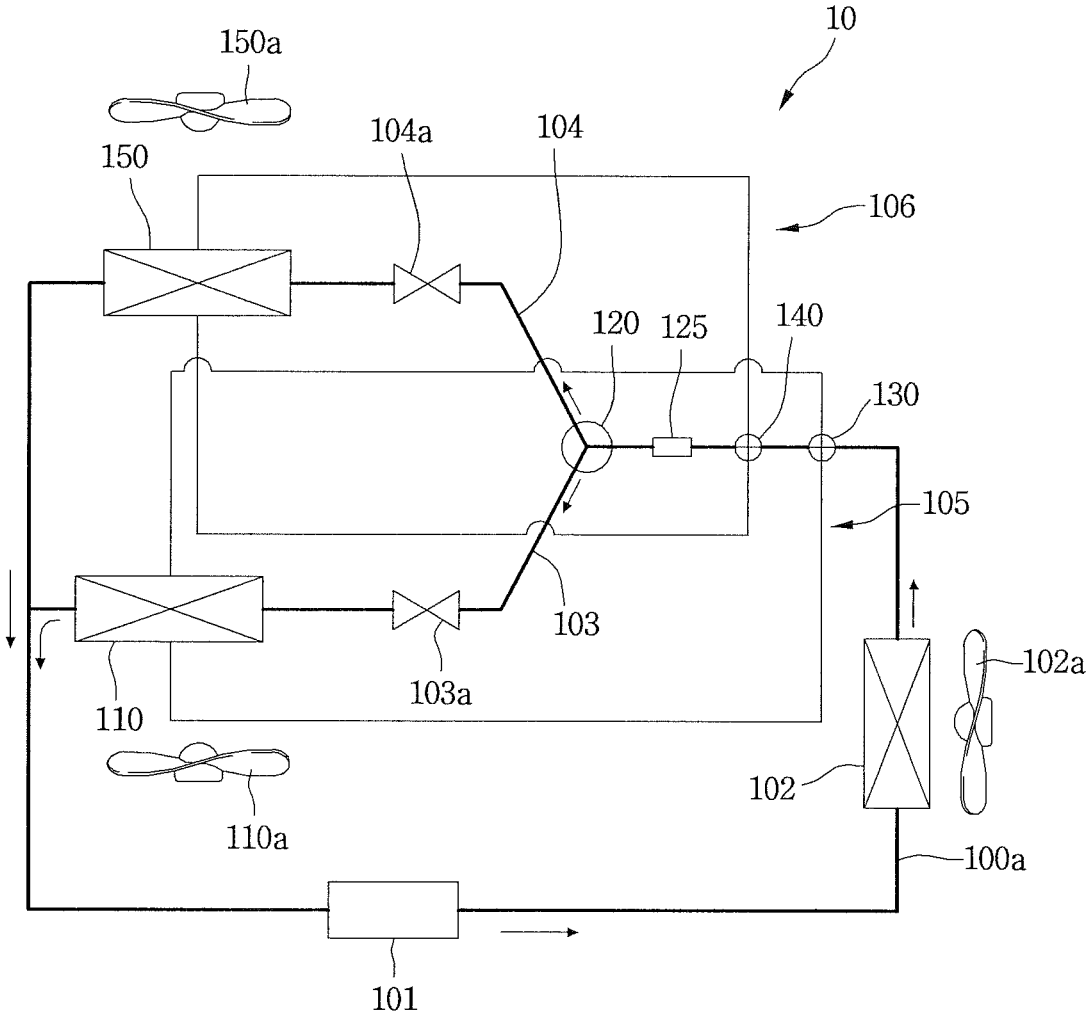
FIG. 5 is a cycle view illustrating a flowing state of a refrigerant in an example of a first mode operation of the refrigerator.
Figure 6A:
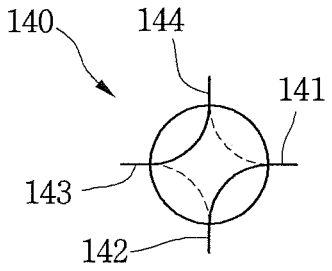
FIGS. 6A and 6B are schematic views illustrating example operating states of the second valve and the third valve in the first mode operation of the refrigerator.
Figure 6B:
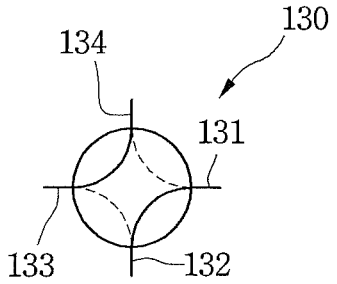

Referring now to FIGS. 5 and 6, when the refrigerator 10 is operated in a normal mode that is a first mode, the second valve 130 and the third valve 140 may be controlled in a predetermined operation mode. The normal mode may refer to an operation mode in which the refrigerant is supplied to at least one or more evaporators of the first and second evaporators 110 and 150, and thus the refrigerator compartment or the freezer compartment is cooled.

For example, FIG. 5 illustrates a state in which the refrigerant is supplied to both of the first and second evaporators 110 and 150, and thus the refrigerator compartment and the freezer compartment are simultaneously cooled. Of course, when it is necessary to cool only the refrigerator compartment, the refrigerant may flow from the first valve 120 only to the first evaporator 110, and when it is necessary to cool only the freezer compartment, the refrigerant may flow from the first valve 120 only to the second evaporator 150. Hereinafter, the case in which the refrigerator compartment and the freezer compartment are simultaneously cooled will be described.

In the normal mode operation of the refrigerator, the refrigerant compressed in the compressor 101 passes through the condenser 102 and is introduced into the second valve 130.

The second valve 130 may be controlled in the first operation mode. Specifically, the first inlet and outlet part 131 and the second inlet and outlet part 132 of the second valve 130 are connected, and the third inlet and outlet part 133 and the fourth inlet and outlet part 134 are connected. Therefore, the refrigerant passed through the condenser 102 is introduced into the second valve 130 through the first inlet and outlet part 131, and discharged from the second valve 130 through the second inlet and outlet part 132. The flow of the refrigerant through the first hot gas path 105 may be restricted.

The third valve 140 may be controlled in the first operation mode. Specifically, the first inlet and outlet part 141 and the second inlet and outlet part 142 of the third valve 140 are connected, and the third inlet and outlet part 143 and the fourth inlet and outlet part 144 are connected. Therefore, the refrigerant passed through the second valve 130 is introduced into the third valve 140 through the first inlet and outlet part 141, and discharged from the third valve 140 through the second inlet and outlet part 142. The flow of the refrigerant through the second hot gas path 106 may be restricted.

The refrigerant discharged from the third valve 140 is introduced into the first valve 120 through the dryer 125. And at the first valve 120, the refrigerant is branched to the first refrigerant path 103 and the second refrigerant path 104, and then introduced into the first evaporator 110 and the second evaporator 150, respectively.

The refrigerant is evaporated in the first and second evaporators 110 and 150, and the cooling air produced in this process may be supplied to each of the refrigerator compartment 20 and the freezer compartment 30. And the refrigerant passed through the first and second evaporators 110 and 150 is combined and suctioned into the compressor 101, compressed in the compressor 101, and then passes through the condenser 102.

Figure 7:
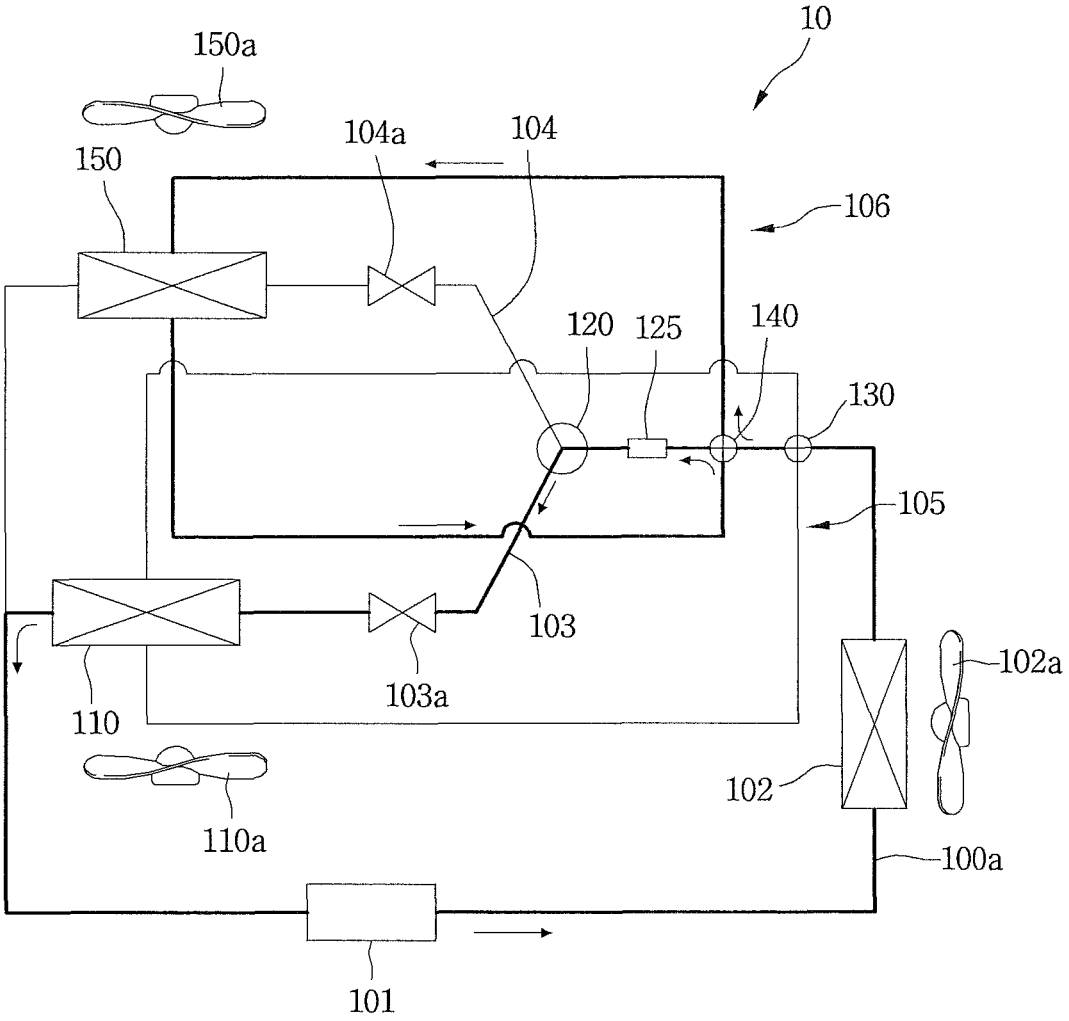
FIG. 7 is a cycle view illustrating the flowing state of the refrigerant in an example of a second mode operation of the refrigerator.
Figure 8A:
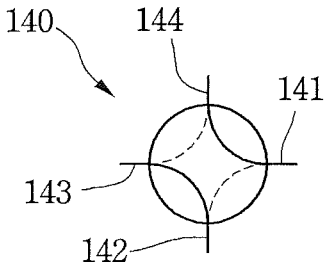
FIGS. 8A and 8B are schematic views illustrating the operating states of the second valve and the third valve in the second mode operation of the refrigerator.
Figure 8B:
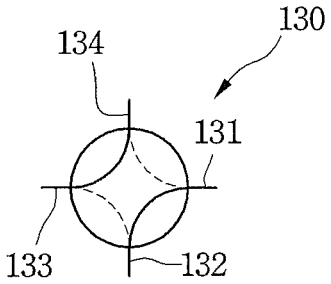

Referring to FIGS. 7 and 8, when the refrigerator 10 is operated in a freezer compartment defrosting mode that is a second mode, the second valve 130 and the third valve 140 may be controlled in a predetermined operation mode. Specifically, in the freezer compartment defrosting mode of the refrigerator 10, the refrigerant compressed in the compressor 101 passes through the condenser 102, and is introduced into the second valve 130.

The second valve 130 may be controlled in the second operation mode. The second operation mode of the second valve 130 is the same as the first operation mode of the second valve 130 in FIG. 6. That is, the first inlet and outlet part 131 and the second inlet and outlet part 132 of the second valve 130 are connected, and the third inlet and outlet part 133 and the fourth inlet and outlet part 134 are connected.

Therefore, the refrigerant passed through the condenser 102 is introduced into the second valve 130 through the first inlet and outlet part 131, and discharged from the second valve 130 through the second inlet and outlet part 132. The refrigerant discharged from the second inlet and outlet part 132 is introduced into the third valve 140, and the flow of the refrigerant through the first hot gas path 105 is restricted.

The third valve 140 may be controlled in the second operation mode. The operation mode of the third valve 140 is different from the first operation mode of the third valve 140 in FIG. 6. Specifically, the first inlet and outlet part 141 and the fourth inlet and outlet part 144 of the third valve 140 are connected, and the second inlet and outlet part 142 and the third inlet and outlet part 143 are connected. Therefore, the refrigerant passed through the second valve 130 is introduced into the third valve 140 through the first inlet and outlet part 141, and introduced into the second hot gas path 106 through the fourth inlet and outlet part 144.

The refrigerant in the second hot gas path 106 passes through the second evaporator 150, and in this process, heat is supplied to the second evaporator 150. Thus ice generated at the second evaporator 150 may be removed. The refrigerant passed through the second evaporator 150 is introduced into the third valve 140 through the third inlet and outlet part 143, and flows toward the first valve 120 through the second inlet and outlet part 142.

The first valve 120 may be operated so that the refrigerant flows to the first refrigerant path 103. Therefore, the refrigerant introduced into the first valve 120 is introduced into the first evaporator 110 through the first refrigerant path 103, and an introduction into the second evaporator 150 is restricted. That is, in the freezer compartment defrosting mode of the refrigerator 10, the introduction of the refrigerant into the second evaporator 150 may be restricted, and a cooling operation of the refrigerator compartment 20 is performed by supplying the refrigerant to the first evaporator 110. According to such an action, the cooling operation of the refrigerator compartment 20 may be performed even when a defrosting operation of the second evaporator 150 is performed, and thus degradation in cooling performance of the refrigerator 10 may be reduced or prevented.

Figure 9:
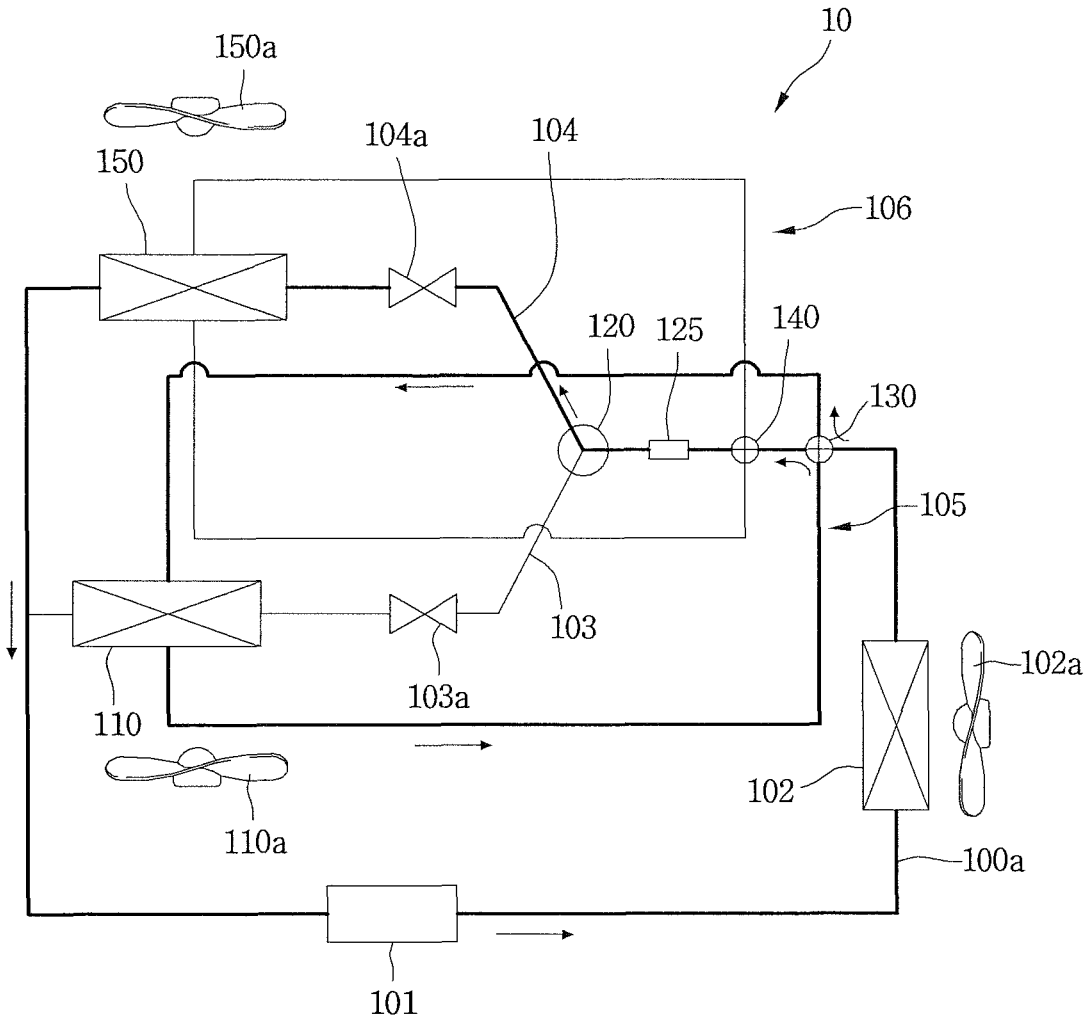
FIG. 9 is a cycle view illustrating the flowing state of the refrigerant in an example of a third mode operation of the refrigerator.
Figure 10A:
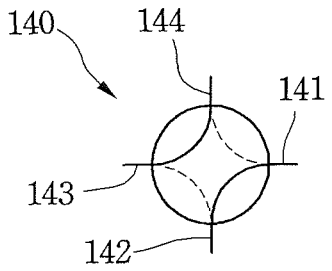
FIGS. 10A and 10B are schematic views illustrating the operating state of the second valve and the third valve in the third mode operation of the refrigerator.
Figure 10B:
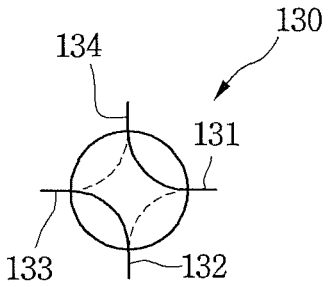

Referring to FIGS. 9 and 10, when the refrigerator 10 is operated in a refrigerator compartment defrosting mode that is a third mode, the second valve 130 and the third valve 140 may be controlled in a predetermined operation mode. Specifically, in the refrigerator compartment defrosting mode of the refrigerator 10, the refrigerant compressed in the compressor 101 passes through the condenser 102, and is introduced into the second valve 130.

The second valve 130 may be controlled in the third operation mode. The third operation mode of the second valve 130 is different from the operation mode of the second valve 130 in FIG. 8. That is, the first inlet and outlet part 131 and the fourth inlet and outlet part 134 of the second valve 130 are connected, and the second inlet and outlet part 132 and the third inlet and outlet part 133 are connected. Therefore, the refrigerant passed through the condenser 102 is introduced into the second valve 130 through the first inlet and outlet part 131, and introduced into the first hot gas path 105 through the fourth inlet and outlet part 134.

The refrigerant in the first hot gas path 105 passes through the first evaporator 110, and in this process, heat is supplied to the first evaporator 110. Thus, ice generated at the first evaporator 110 may be removed. The refrigerant passed through the first evaporator 110 is introduced into the second valve 130 through the third inlet and outlet part 133, and flows toward the third valve 140 through the second inlet and outlet part 132.

The third valve 140 may be controlled in the third operation mode. The third operation mode of the third valve 140 is the same as the operation mode of the third valve 140 in FIG. 6. That is, the first inlet and outlet part 141 and the second inlet and outlet part 142 of the third valve 140 may be connected, and the third inlet and outlet part 143 and the fourth inlet and outlet part 144 may be connected. Therefore, the refrigerant passed through the second valve 130 is introduced into the third valve 140 through the first inlet and outlet part 141, and discharged from the third valve 140 through the second inlet and outlet part 142.

The refrigerant discharged from the third valve 140 may be introduced into the first valve 120 via the dryer 125. The first valve 120 may be operated so that the refrigerant flows to the second refrigerant path 104. Therefore, the refrigerant introduced into the first valve 120 is introduced into the second evaporator 150 through the second refrigerant path 104, and an introduction into the first evaporator 110 is restricted. That is, in the refrigerator compartment defrosting mode of the refrigerator 10, the introduction of the refrigerant into the first evaporator 110 is restricted, and the cooling operation of the freezer compartment 30 is performed by supplying the refrigerant to the second evaporator 150. According to such an action, the cooling operation of the freezer compartment 30 may be performed even when the defrosting operation of the first evaporator 110 is performed, and thus degradation in cooling performance of the refrigerator 10 may be reduced or prevented.

Hereinafter, a configuration of the second evaporator 150 is mainly described. Since the configuration of the first evaporator 110 is similar to that of the second evaporator 150, detailed description thereof will be omitted, and description of the second evaporator 150 will be quoted.

Figure 11:
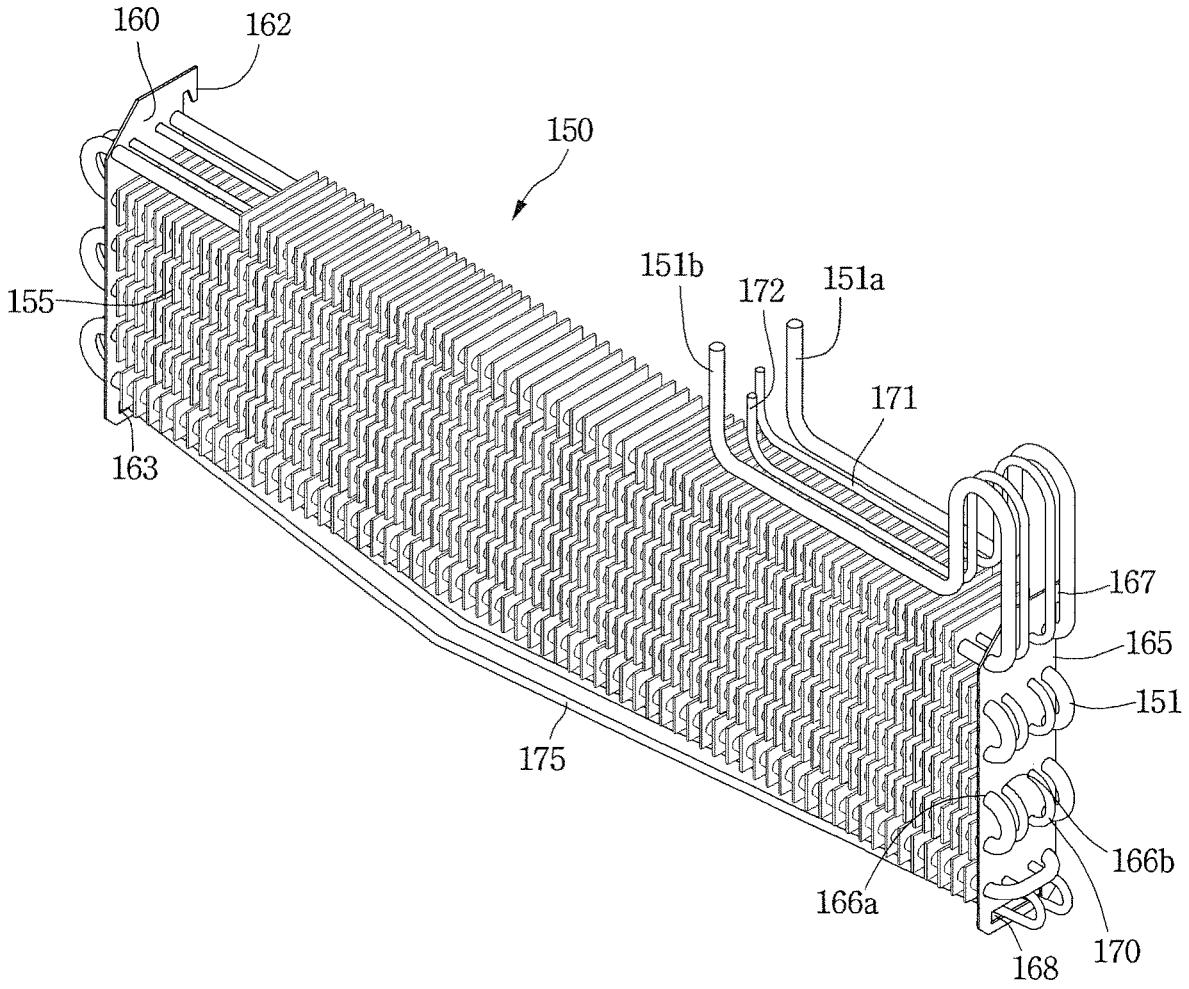
FIG. 11 is a perspective view showing an example evaporator.
Figure 12:
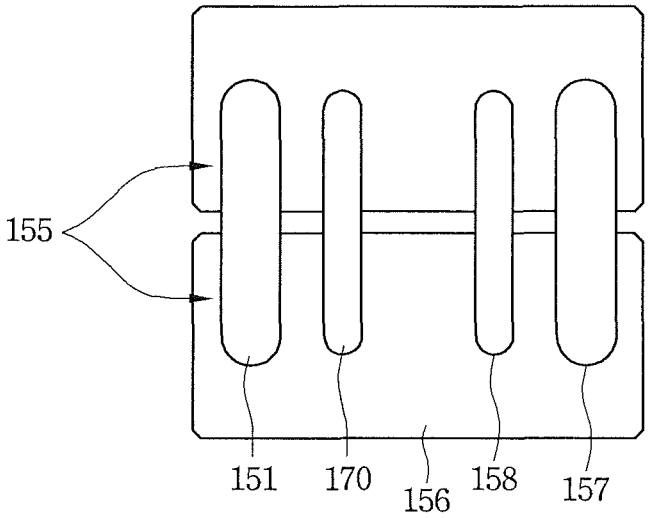
FIG. 12 is a partial view illustrating an example state in which first and second pipes and a fin are coupled.

Referring to FIG. 11, the second evaporator 150 includes a plurality of refrigerant pipes 151 and 170 through which refrigerant having different phases from each other flows, and a fin 155 that is coupled to the plurality of refrigerant pipes 151 and 170 and increases a heat exchange area between the refrigerant and a fluid.

Specifically, the plurality of refrigerant pipes 151 and 170 may include a first pipe 151 through which the refrigerant depressurized in the second expander 104*a* flows, and a second pipe 170 through which the refrigerant condensed in the condenser 102 is supplied. That is, the second pipe 170 forms at least a part of the first hot gas path 105, and may be referred to as a "hot gas pipe."

The first evaporator 110 may include a first pipe through which the refrigerant depressurized in the first expander 103*a* flows, and a second pipe through which the refrigerant condensed in the condenser 102 is supplied, i.e., which forms at least a part of the first hot gas path 105.

The refrigerant in the second pipe 170 may be a refrigerant that is not depressurized in the second expander 104*a*, i.e., which bypasses the second expander 104*a*, and may have a temperature higher than that of the refrigerant flowing through the first pipe 151.

The evaporator 150 can further include coupling plates 160 and 165 which fix the first pipe 151 and the second pipe 170.

Specifically, a plurality of coupling plates 160 and 165 may be provided at both sides of the evaporator 150. Also, the coupling plates 160 and 165 may include a first plate 160 which supports one side of each of the first pipe 151 and the second pipe 170, and a second plate 165 which supports the other side of each of the first pipe 151 and the second pipe 170. The first and second plates 160 and 165 may be disposed to be spaced apart from each other.

The first pipe 151 and the second pipe 170 may be bent in one direction from the first plate 160 toward the second plate 165 and the other direction from the second plate 165 toward the first plate 160.

The first and second plates 160 and 165 may serve to fix both sides of the first pipe 151 and the second pipe 170, and to prevent shaking of the first pipe 151 and the second pipe 170. For example, the first pipe 151 and the second pipe 170 may be disposed to pass through the first and second plates 160 and 165.

Each of the first and second plates 160 and 165 can have a plate shape that extends longitudinally, and may have through-holes 166*a* and 166*b* through which at least parts of the first pipe 151 and 170 pass. Specifically, the through-holes 166*a* and 166*b* may include a first through-hole 166*a* through which the first pipe 151 passes, and the second through-hole 166*b* through which the second pipe 170 passes.

The first pipe 151 may be disposed to pass through the first through-hole 166*a* of the first plate 160, to extend toward the second plate 165, and to pass through the first through-hole 166*a* of the second plate 165, and then a direction thereof may be changed so as to extend again toward the first plate 160.

The second pipe 170 may be disposed to pass through the second through-hole 166*b* of the first plate 160, to extend toward the second plate 165, and to pass through the second through-hole 166*b* of the second plate 165, and then a direction thereof may be changed so as to extend again toward the first plate 160.

The evaporator 150 can include a first inlet part 151*a* which guides the introduction of the refrigerant into the first pipe 151, and a first outlet part 151*b* which guides the discharge of the refrigerant flowed through the first pipe 151. The first inlet part 151*a* and the first outlet part 151*b* may form at least a part of the first pipe 151.

The evaporator 150 can include a second inlet part 171 which guides the introduction of the refrigerant into the second pipe 170, and a second outlet part 172 which guides the discharge of the refrigerant flowed through the second pipe 170. The second inlet part 171 and the second outlet part 172 may form at least a part of the second pipe 170.

As an example, in the defrosting mode of the second evaporator 150, the high temperature refrigerant condensed in the condenser 102 is introduced into the second evaporator 150 through the second inlet part 171, removes the ice generated at the second evaporator 150 during the heat exchange process, and then discharged from the second evaporator 150 through the second outlet part 172.

A plurality of fins 155 may be provided to be spaced apart from each other. The first pipe 151 and the second pipe 170 may be disposed to pass through the plurality of fins 155. Specifically, the fins 155 may be disposed to vertically and horizontally form a plurality of rows.

The coupling plates 160 and 165 can include the hooks 162 and 167 which are coupled to the inner case 13. The hooks 162 and 167 may be disposed at upper portions of the coupling plates 160 and 165, respectively. Specifically, the hooks 162 and 167 may include a first hook 162 that is provided at the first plate 160, and a second hook 167 that is provided at the second plate 165.

First and second support parts 163 and 168 through which the second pipe 170 passes may be formed at the coupling plates 160 and 165, respectively. The first and second support parts 163 and 168 may be disposed at lower portions of the coupling plates 160 and 165, respectively. Specifically, the first and second support parts 163 and 168 can include a first support part 163 that is provided at the first plate 160, and a second support part 168 that is provided at the second plate 165.

The second pipe 170 can include an extension part 175 which forms a lower end of the evaporator 150. Specifically, the extension part 175 may extend downward further than a lowermost fin 155 of the plurality of fins 155. The extension part 175 may be located inside a water collection part 180 (referring to FIG. 11) which will be described later, and may supply heat to remaining frost in the water collection part 180. Defrosted water may be drained to a machinery compartment 50.

Due to the extension part 175, the second pipe 170 may have a shape that is inserted into the first and second support parts 163 and 168 and extends to a central portion of the evaporator 150. That is, due to a configuration in which the second pipe 170 passes and extends through the first and second support parts 163 and 168, the extension part 175 may be stably supported by the evaporator 150.

The first pipe 151 and the second pipe 170 may be installed to pass through the plurality of fins 155. The plurality of the fins 155 may be disposed to be spaced apart from each other at a predetermined distance. Specifically, each of the fins 155 includes a fin body 156 having an approximately quadrangular plate shape, and a plurality of through-holes 157 and 158 which are formed at the fin body 156 and through which the first pipe 151 and the second pipe 170 pass. The plurality of through-holes 157 and 158 includes a first through-hole 157 through which the first pipe 151 passes, and a second through-hole 158 through which the second pipe 170 passes. The plurality of through-holes 157 and 158 may be disposed in one row.

An inner diameter of the first through-hole 157 may have a size different from that of an inner diameter of the second through-hole 158. For example, the inner diameter of the first through-hole 157 may be larger than that of the second through-hole 158. In other words, an outer diameter of the first pipe 151 may be larger than that of the second pipe 170.

This may be because the first pipe 151 guides the flow of the refrigerant which performs an innate function of the evaporator 150, and thus a relatively larger flow rate of the refrigerant is required. However, since the second pipe 170 guides the flow of the high temperature refrigerant for a predetermined time only when the defrosting operation of the evaporator 150 is required, a relatively smaller flow rate of the refrigerant may be required.

Figure 13:
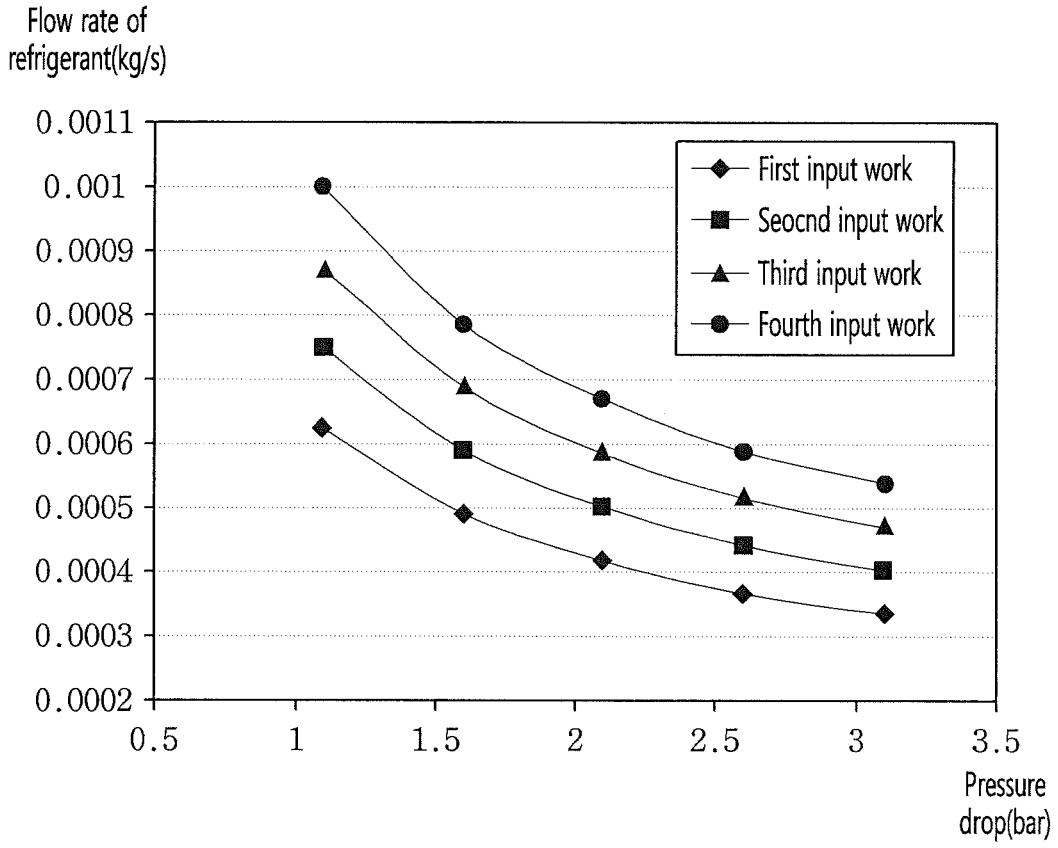
FIGS. 13 to 16 are exemplary graphs illustrating results of an experiment performed according to various sample conditions in the refrigerator.

FIG. 13 is a sample experimental graph illustrating a change of the flow rate kg/s of the refrigerant which circulates in the refrigeration cycle of the refrigerator 10 according to an increase in a pressure drop bar with respect to a predetermined input work of the compressor 101.

The illustrated sample experiment was performed four times while the input work of the compressor 101 was changed. The input work was increased from a first input work to a fourth input work of the compressor 101. For example, a second input work may be determined larger by 20% than the first input work, a third input work may be determined larger by 40% than the first input work, and the fourth input work may be determined larger by 60% than the first input work. This definition may be equally applied to FIG. 14.

A pressure drop of a transverse axis indicates a pressure that is reduced in the first expander 103*a* or the second expander 104*a* after defrosting one preset evaporator but before being introduced into the other evaporator. Based on a predetermined pressure drop, it may be understood that a flow rate of the refrigerant is increased as the input work of the compressor 101 is increased.

As the pressure drop becomes smaller, the flow rate of the refrigerant may be increased. That is, as an opening degree of the first expander 103*a* or the second expander 104*a* is increased, the pressure drop may be reduced, but the flow rate of the refrigerant may be increased. For example, when the first expander 103*a* or the second expander 104*a* is in the form of a capillary tube, as a diameter of the capillary tube becomes larger or a length of the capillary tube becomes shorter, the pressure drop may be reduced, and the flow rate of the refrigerant may be increased.

Figure 14:
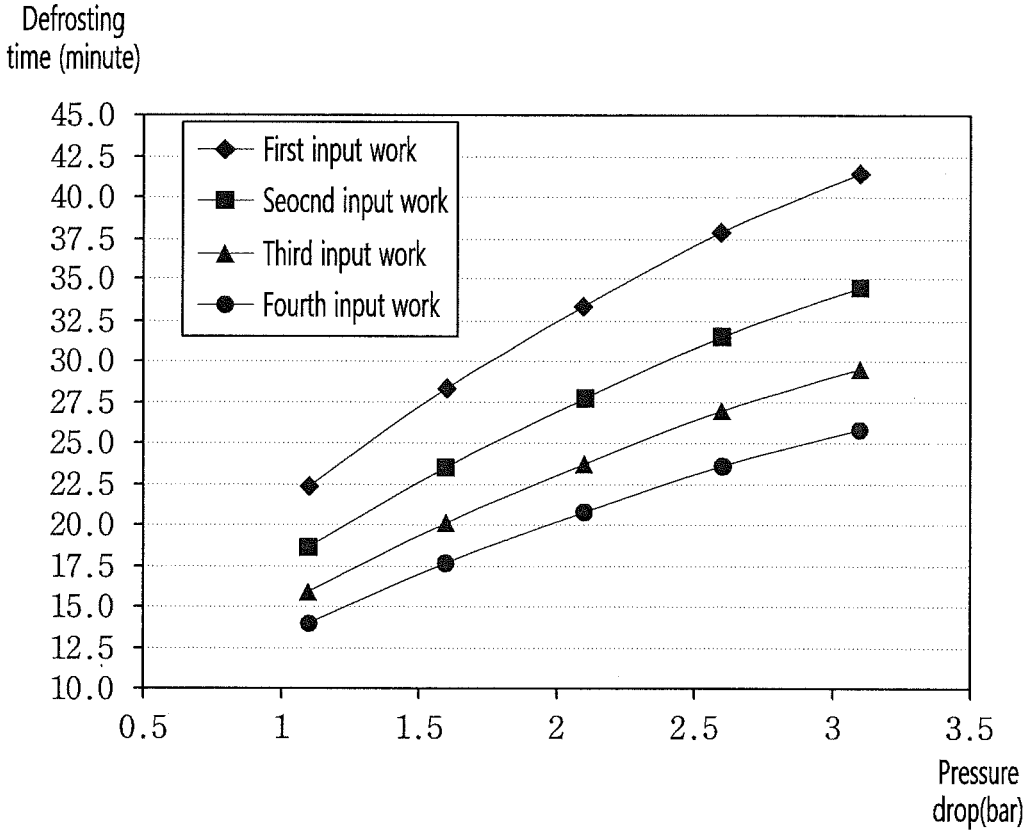

As illustrated in the example results shown in FIG. 14, as the pressure drop becomes smaller, the defrosting time becomes shorter. That is, as the pressure drop becomes smaller, the flow rate of the refrigerant flowing through the first hot gas path 105 or the second hot gas path 106 is increased. Accordingly, the defrosting performance is improved, and thus the defrosting time becomes shorter. As the work input to the compressor 101 is increased, the flow rate of the refrigerant circulating the system is increased, and the defrosting time may be shorter.

In brief, as the pressure drop becomes smaller, the flow rate of the refrigerant may be increased, and the defrosting time may be shorter. However, when the pressure drop is too small, an evaporation temperature of the evaporator which does not perform the defrosting operation, i.e. the evaporator for the cooling operation is relatively increased, and the cooling operation may not be effectively performed.

Figure 15:
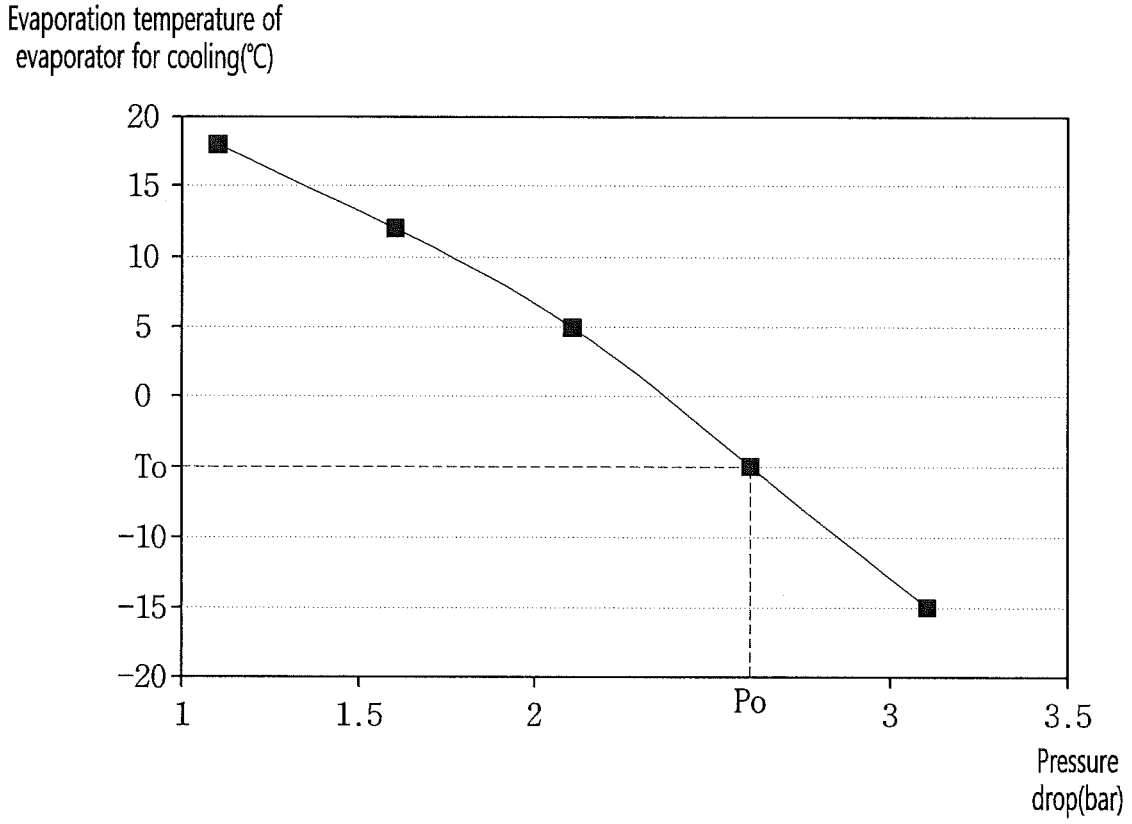

Referring now to the example results shown in FIG. 15, it may be understood that an evaporation temperature of the evaporator for the cooling operation that is indicated at a vertical axis is reduced, as the pressure drop of the horizontal axis is increased. For example, the graph in FIG. 15 shows an experimental data in case of defrosting of the freezer compartment evaporator and cooling of the refrigerator compartment.

Therefore, to maintain the evaporator temperature of the evaporator for the cooling operation at a set value To or less while ensuring the defrosting performance having a set level or more, the refrigerator 10 according to the implementation may be designed so that the pressure drop is maintained at a set value Po or more. That is, the length or an inner diameter of the first expander 103*a* or the second expander 104*a* may be determined so that the pressure drop is maintained at the set value Po or more. For example, the set value To of the evaporation temperature may be about −5° C., and the set value Po of the pressure drop may be about 2.5 bar.

Figure 16:
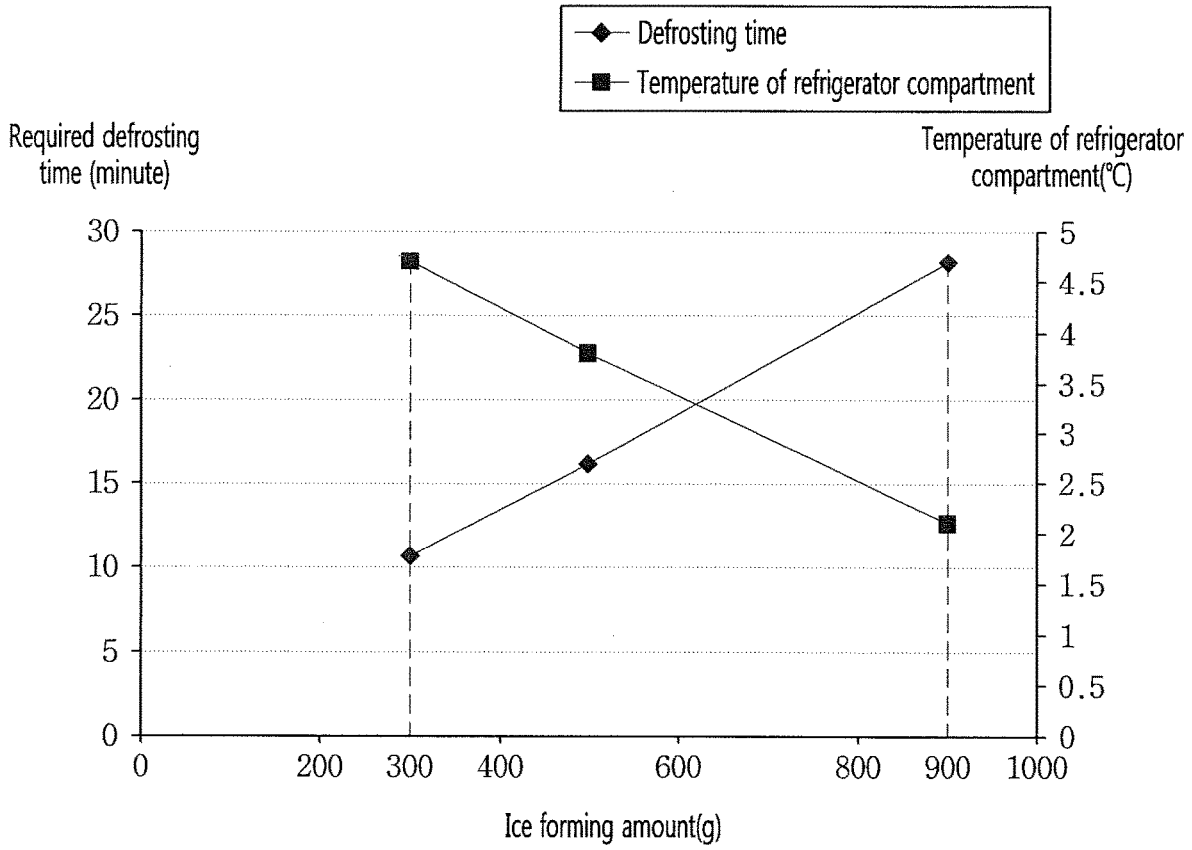

FIG. 16 is a sample experimental graph illustrating a change in a temperature of the refrigerator compartment after the defrosting operation is terminated and the defrosting time required according to an ice forming amount on the freezer compartment evaporator 150 when the refrigerator 10 is operated in the freezer compartment defrosting mode.

Specifically, as the ice forming amount on the freezer compartment evaporator 150 becomes smaller, the defrosting time is reduced, and a temperature of the refrigerator compartment 20 may be increased after the defrosting operation is terminated. For example, when the ice of less than 300 g is formed on the freezer compartment evaporator 150 (an ice forming amount of 300 g), a time required for the defrosting operation is about 10 minutes, and the temperature of the refrigerator compartment 20 after the defrosting operation is terminated is about 4.7° C. And when the ice forming amount is 500 g, the time required for the defrosting operation is about 16 minutes, and the temperature of the refrigerator compartment 20 after the defrosting operation is terminated is about 3.8° C. When the ice forming amount is 900 g, the time required for the defrosting operation is about 28 minutes, and the temperature of the refrigerator compartment 20 after the defrosting operation is terminated is about 2.1° C.

When the ice forming amount on the freezer compartment evaporator 150 is too much, the defrosting time may be increased. While the freezer compartment evaporator 150 is defrosted, a condensing temperature of the refrigerant flowing through the second hot gas path 106 becomes too low, and the evaporation temperature of the refrigerator compartment evaporator 110 becomes low, and thus the temperature of the refrigerator compartment 20 is lowered less than a set value.

However, as illustrated in the sample experimental graph of FIG. 16, when the ice forming amount on the freezer compartment evaporator 150 is about 900 g, the temperature of the refrigerator compartment 20 is about 2° C. When it is considered that the temperature of the refrigerator compartment 20 is formed within a range of 0 to 5° C., it may be understood that a temperature range of 21° C. accords with a required level.

In brief, even though rather a lot of ice forming amount (about 900 g) is formed on the freezer compartment evaporator 150, the refrigerator compartment 20 in which the cooling operation is performed is not supercooled while the refrigerator 10 is operated in the freezer compartment defrosting mode.

Figure 17:
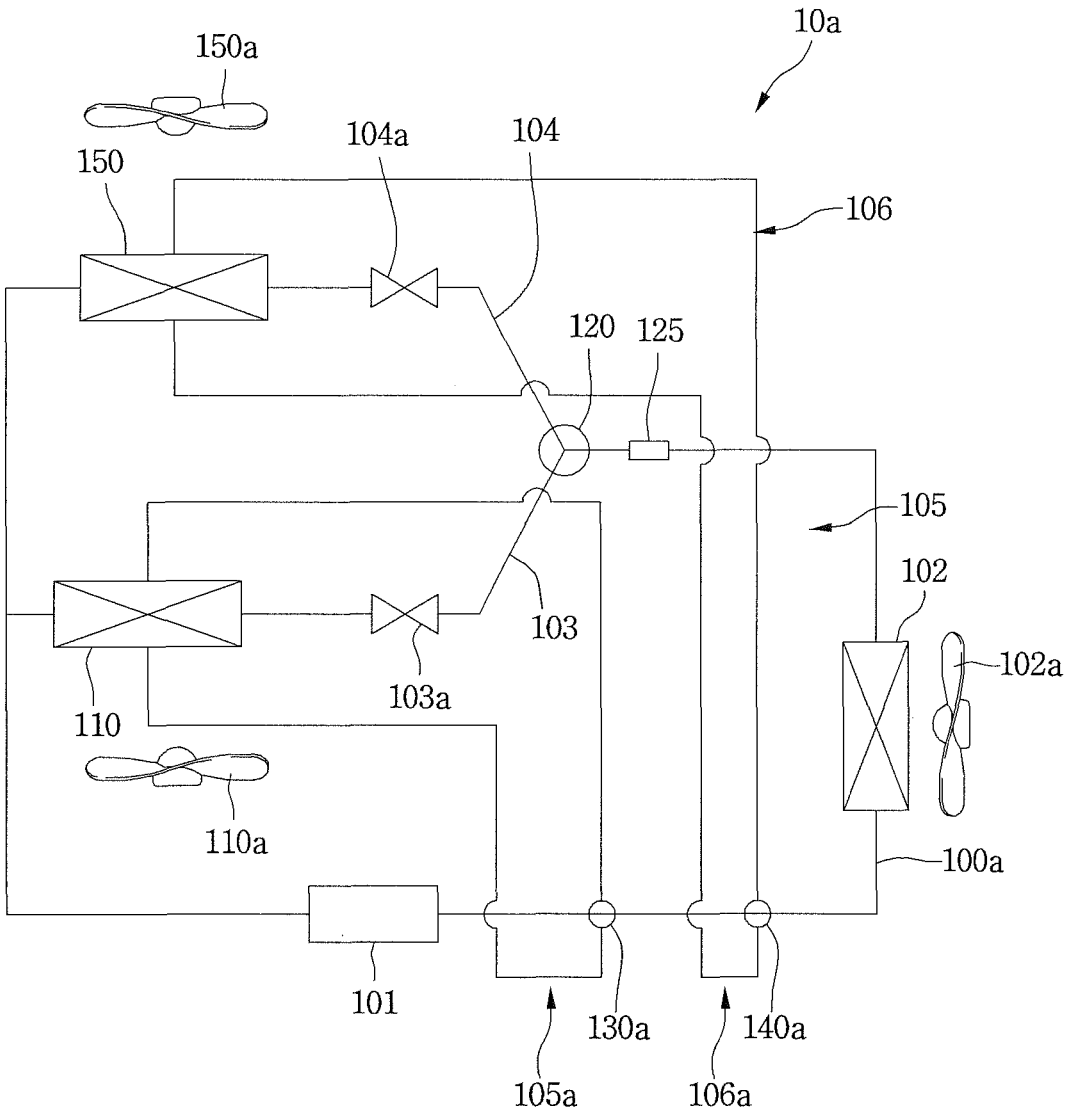
FIG. 17 is a cycle view illustrating an example configuration of a refrigerator according to another implementation.

FIG. 17 is a cycle view illustrating an example configuration of a refrigerator according to another implementation of the present disclosure. The implementation is characterized in that installation positions of the second and third valves are different from those of the second and third valves which have been described in the first implementation. Descriptions and reference numerals of other elements are the same as those thereof in the first implementation.

Referring to FIG. 17, a refrigerator 10*a* according to a second implementation of the present disclosure includes a second valve 130*a* and a third valve 140*a* which are installed at an inlet side of the condenser 102.

The second valve 130*a* may be a valve device that can be controlled to supply the high temperature refrigerant discharged from the compressor 101 toward the first evaporator 110. The refrigerator 10*a* further includes a first hot gas path 105*a* which extends from the second valve 130*a* to the first evaporator 110.

In the refrigerator compartment defrosting mode of the refrigerator 10*a*, the refrigerant discharged from the compressor 101 is introduced into the second valve 130*a*, and may flow from the second valve 130*a* through the first hot gas path 105*a*. And the refrigerant may remove the ice formed on the first evaporator 110 while passing through the first evaporator 110.

The third valve 140*a* is a valve device which may be controlled to supply the high temperature refrigerant discharged from the compressor 101 toward the second evaporator 150, and may be installed at an outlet side of the second valve 130*a*. The refrigerator 10*a* may further include second hot gas path 106*a* which extends from the third valve 140*a* to the second evaporator 150.

In the freezer compartment defrosting mode of the refrigerator 10*a*, the refrigerant discharged from the compressor 101 is introduced into the third valve 140*a* via the second valve 130*a*, and may flow from the third valve 140*a* through the second hot gas path 106*a*. The refrigerant may remove the ice formed on the second evaporator 150 while passing through the second evaporator 150. As describe above, the defrosting of the first evaporator 110 or the second evaporator 150 may be performed using the high temperature refrigerant discharged from the compressor 101.

Figure 18:
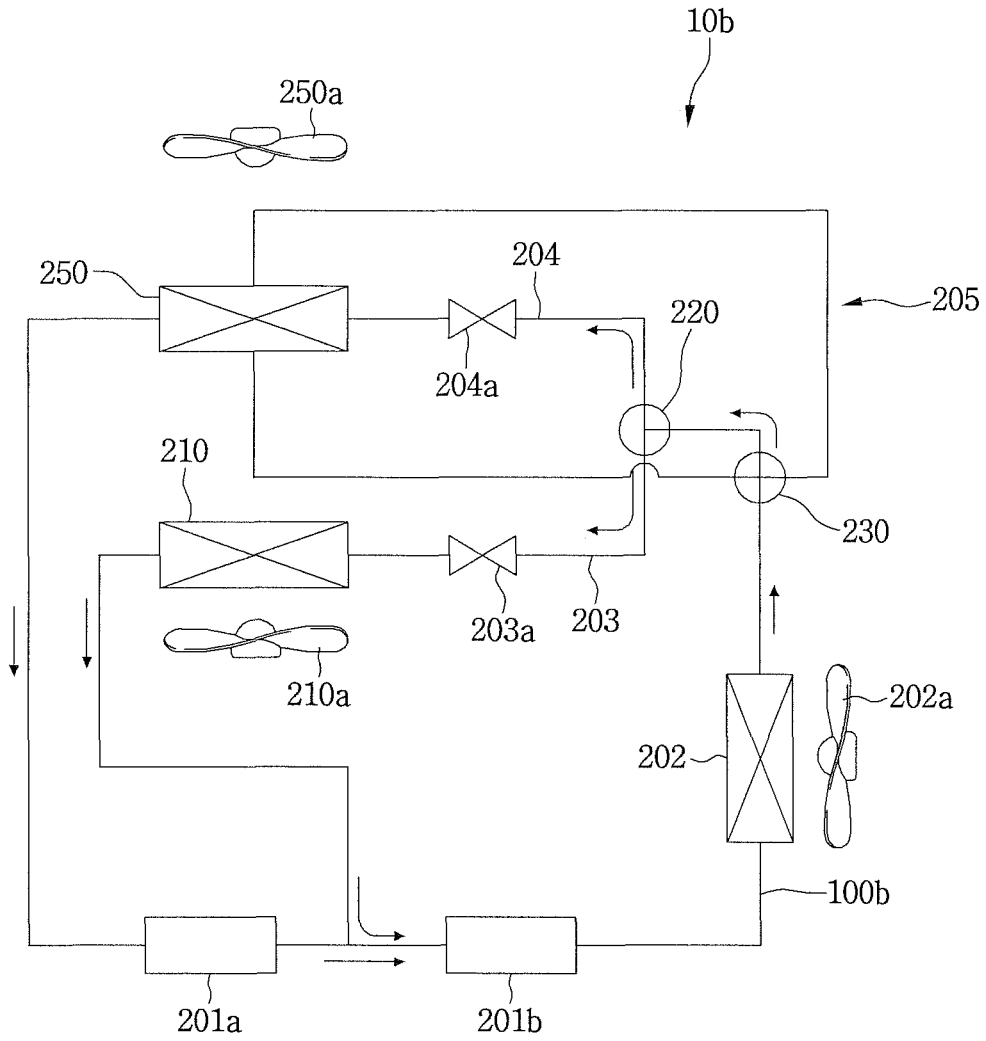
FIG. 18 is a cycle view illustrating an example configuration of a refrigerator according to yet another implementation.

Referring now to FIG. 18, a refrigerator 10*b* according to yet another implementation of the present disclosure includes a plurality of compressors 201*a* and 201*b* which compress a refrigerant, a condenser 202 which condenses the refrigerant compressed in the plurality of compressors 201*a* and 201*b*, a plurality of expanders 203*a* and 204*a* which depressurizes the refrigerant condensed in the condenser 202, and a plurality of evaporators 210 and 250 which evaporate the refrigerant depressurized in the plurality of expanders 203*a* and 204*a*.

The refrigerator 10*b* may further include a refrigerant pipe 100*b* which connects the compressors 201*a* and 201*b*, the condenser 202, the expanders 203*a* and 204*a* and the evaporators 210 and 250 and guides a flow of the refrigerant.

The plurality of compressors 201*a* and 201*b* may include a first compressor 201*a* that is disposed at a low pressure side, and a second compressor 201*b* that is disposed at a high pressure side. The second compressor 201*b* may be installed at an outlet side of the first compressor 201*a*, and configured to secondarily compress the refrigerant that is primarily compressed in the first compressor 201*a*.

The plurality of evaporators 210 and 250 may include a first evaporator 210 that serves as a "refrigerator compartment evaporator" for generating the cooling air which will be supplied to the refrigerator compartment 20, and a second evaporator 250 that serves as a "freezer compartment evaporator" for generating the cooling air which will be supplied to the freezer compartment 30. The first and second evaporators 210 and 250 can be connected in parallel. Description of the first and second evaporators 210 and 250 in quotes the description of the first and second evaporators 110 and 150 of the first implementation.

An outlet side pipe of the first evaporator 210 may be connected to a suction side of the second compressor 201*b*. An outlet side pipe of the second evaporator 250 may be connected to a suction side of the first compressor 201*a*. For example, the refrigerant that is primarily compressed in the first compressor 201*a* may be combined with the refrigerant passed through the first evaporator 210, may be suctioned into the second compressor 201*b*, and then may be secondarily compressed in the second compressor 201*b*.

The plurality of expanders 203*a* and 204*a* may include a first expander 203*a* for expanding the refrigerant which will be introduced into the first evaporator 210, and a second expander 204*a* for expanding the refrigerant which will be introduced into the second evaporator 250. Each of the first and second expanders 203*a* and 204*a* may include a capillary tube.

A diameter of the capillary tube of the second expander 204*a* may be smaller than that of the capillary tube of the first expander 203*a* so that a refrigerant evaporation pressure of the second evaporator 250 is formed smaller than that of the first evaporator 210.

The refrigerator 10*b* can include a first refrigerant path 203 and a second refrigerant path 204 which are branched from the refrigerant pipe 100*b*. The first refrigerant path 203 may be connected to the first evaporator 210, and the second refrigerant path 204 may be connected to the second evaporator 250. The first expander 203*a* may be installed at the first refrigerant path 203, and the second expander 204*a* may be installed at the second refrigerant path 204.

The refrigerator 10*b* can further include a first valve 220 that branches the refrigerant to the first and second refrigerant paths 203 and 204. The first valve 220 may be understood as a device which controls a flow of the refrigerant so that the first and second evaporators 210 and 250 are operated simultaneously or separately, that is, the refrigerant may be introduced into at least one of the first evaporator 210 and the second evaporator 250.

The first valve 220 can include a three-way valve having one inlet part through which the refrigerant is introduced and two outlet parts through which the refrigerant is discharged. Description of the first valve 220 of the present implementation quotes that of the first valve 120 of the first implementation.

The refrigerator 10*b* further includes a hot gas path 205 for supplying the refrigerant condensed in the condenser 202 to the second evaporator 250, and a second valve 230 that is controlled to selectively supply the condensed refrigerant to the second evaporator 250. For example, the second valve 230 may include a four-way valve having four inlet and outlet parts.

The second valve 230 may be installed at the refrigerant pipe 100*b* located at an outlet side of the condenser 202, and the hot gas path 205 may be formed to be connected from a fourth inlet and outlet part 234 (referring to FIG. 19) of the second valve 230 to a third inlet and outlet part 233 of the second valve 230 via the second evaporator 250. That is, the hot gas path 205 may form a closed loop which passes through the second valve 230 and the second evaporator 250.

The first valve 220 may be a valve device which branches the refrigerant to the plurality of evaporators 210 and 250, and may be referred to as an "evaporator inlet valve device." The second valve 230 is a valve device which guides the refrigerant to the hot gas path 205, and may be referred to as a "hot gas valve device."

The refrigerator 10*b* further includes fans 202*a*, 210*a* and 250*a* which are provided at one side of the heat exchanger to blow air. The fans 202*a*, 210*a* and 250*a* include a condensation fan 202*a* that is provided at one side of the condenser 202, a first evaporation fan 210*a* that is provided at one side of the first evaporator 210, and a second evaporation fan 250*a* that is provided at one side of the second evaporator 250.

An operation mode of the second valve 230 may be determined according to an operation mode of the refrigerator 10*b*, and whether the refrigerant flows through the hot gas path 205 may be determined based on the operation mode of the second valve 230.

Figure 19:
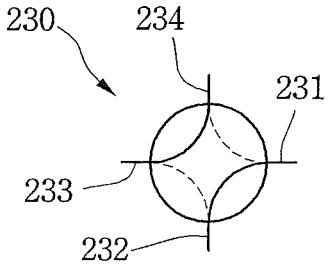
FIG. 19 is a schematic view illustrating an operating state of a second valve in an example of a first mode operation of the refrigerator in FIG. 18.

Specifically, referring to FIG. 19, the second valve 230 includes four inlet and outlet parts 231, 232, 233, and 234.

The four inlet and outlet parts 231, 232, 233, and 234 include a first inlet and outlet part 231 that is connected to an outlet side pipe of the condenser 202, a second inlet and outlet part 232 that is connected to the first valve 220, the third inlet and outlet part 233 that is connected to the hot gas path 205 and through which the refrigerant passed through the second evaporator 250 is introduced, and the fourth inlet and outlet part 234 that is connected to the hot gas path 205 and through which the refrigerant to be introduced into the second evaporator 250 is discharged. That is, based on the hot gas path 205, the third inlet and outlet part 233 of the second valve 230 is connected to the outlet side pipe of the second evaporator 250, and the fourth inlet and outlet part 234 is connected to an inlet side pipe of the second evaporator 250.

When the refrigerator 10*b* is operated in a normal mode that is a first mode, the second valve 230 may be controlled in a predetermined operation mode. The normal mode may be understood as an operation mode in which the refrigerant is supplied to at least one or more evaporators of the first and second evaporators 210 and 250, and thus the refrigerator compartment or the freezer compartment is cooled.

For example, FIG. 18 illustrates a state in which the refrigerant is supplied to both of the first and second evaporators 210 and 250, and thus the refrigerator compartment and the freezer compartment are simultaneously cooled. Of course, when it is necessary to cool only the refrigerator compartment, the refrigerant may flow from the first valve 220 only to the first evaporator 210, and when it is necessary to cool only the freezer compartment, the refrigerant may flow from the first valve 220 only to the second evaporator 250. Hereinafter, the case in which the refrigerator compartment and the freezer compartment are simultaneously cooled will be described.

In the normal mode operation of the refrigerator 10*b*, the refrigerant compressed in the first and second compressors 201*a* and 201*b* passes through the condenser 202 and is introduced into the second valve 230. The second valve 230 may be controlled in the first operation mode. Specifically, the first inlet and outlet part 231 and the second inlet and outlet part 232 of the second valve 230 are connected, and the third inlet and outlet part 233 and the fourth inlet and outlet part 234 are connected. Therefore, the refrigerant passed through the condenser 202 is introduced into the second valve 230 through the first inlet and outlet part 231, and discharged from the second valve 230 through the second inlet and outlet part 232. And the flow of the refrigerant through the hot gas path 205 may be restricted.

The refrigerant discharged from the second valve 230 is introduced into the first valve 220. And at the first valve 220, the refrigerant may be branched to the first refrigerant path 203 and the second refrigerant path 204, and then introduced into the first evaporator 210 and the second evaporator 250, respectively. The refrigerant is evaporated in the first and second evaporators 210 and 250, and the cooling air produced in this process may be supplied to each of the refrigerator compartment 20 and the freezer compartment 30, and may cool the storage compartments 20 and 30.

The refrigerant passed through the second evaporator 250 is suctioned into the first compressor 201*a*, primarily compressed, and then combined with the refrigerant passed through the first evaporator 210. The combined refrigerant may be suctioned into the second compressor 201*b*, and then may be secondarily compressed. The refrigerant compressed in the second compressor 201*b* flows to the condenser 202.

Figure 20:
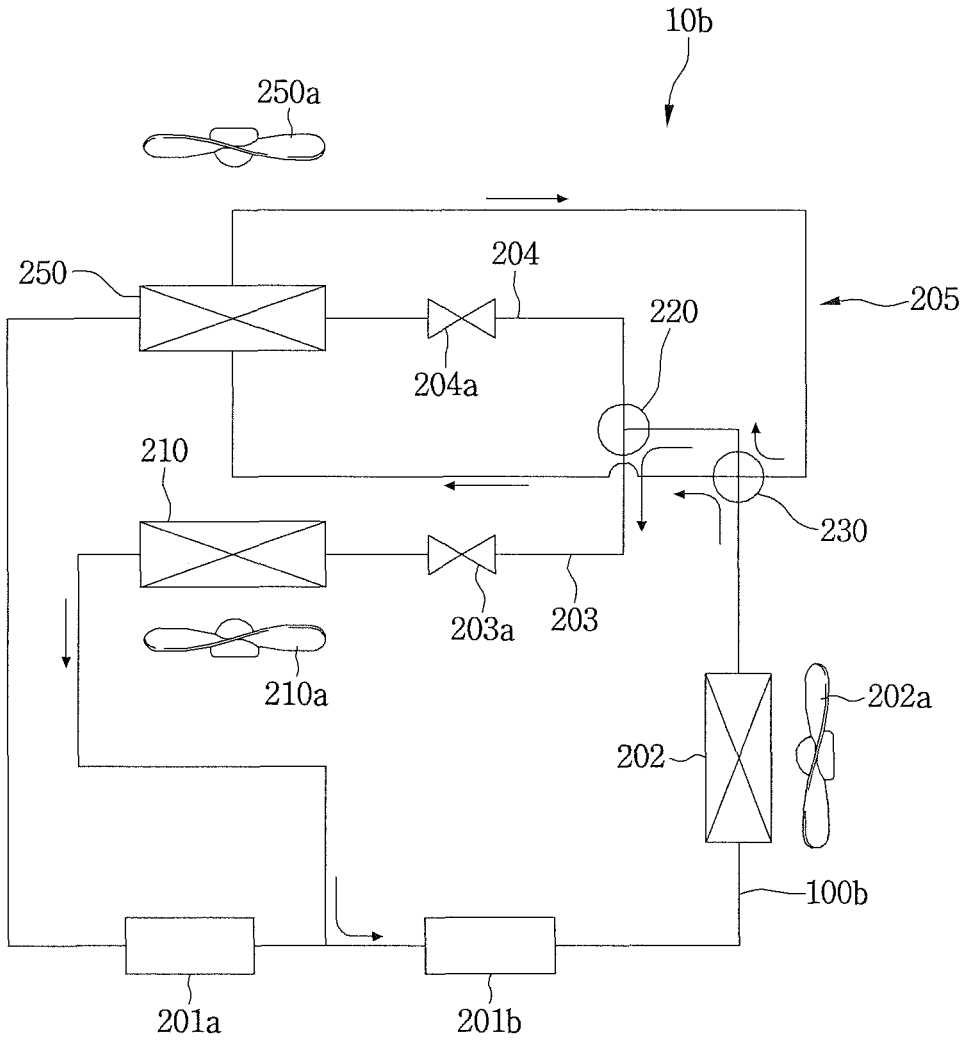
FIG. 20 a cycle view illustrating a flowing state of a refrigerant in an example of a second mode operation of the refrigerator in FIG. 18.
Figure 21:
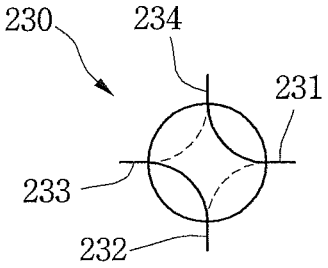
FIG. 21 is a schematic view illustrating the operating state of the second valve in the second mode operation of the refrigerator in FIG. 18.

Referring now to FIGS. 20 and 21, when the refrigerator 10*b* is operated in a freezer compartment defrosting mode that is a second mode, the second valve 230 may be controlled in a predetermined operation mode. Specifically, in the freezer compartment defrosting mode of the refrigerator 10*b*, the refrigerant compressed in the second compressor 201*b* passes through the condenser 202, and is introduced into the second valve 230.

The second valve 230 may be controlled in the second operation mode. Specifically, the second valve 230 may be operated so that the first inlet and outlet part 231 and the fourth inlet and outlet part 234 are connected, and the second inlet and outlet part 232 and the third inlet and outlet part 233 are connected. Therefore, the refrigerant passed through the condenser 202 is introduced into the second valve 230 through the first inlet and outlet part 231, and introduced into the hot gas path 205 through the fourth inlet and outlet part 234.

The refrigerant in the hot gas path 205 may pass through the second evaporator 250, and in this process, heat can be supplied to the second evaporator 250, and thus the ice generated at the second evaporator 250 may be removed. The refrigerant passed through the second evaporator 250 is introduced into the second valve 230 through the third inlet and outlet part 233, and flows toward the first valve 220 through the second inlet and outlet part 232.

The first valve 220 may be operated so that the refrigerant flows to the first refrigerant path 203. Therefore, the refrigerant introduced into the first valve 220 is introduced into the first evaporator 210 through the first refrigerant path 203, and an introduction into the second evaporator 250 is restricted. That is, in the freezer compartment defrosting mode of the refrigerator 10*b*, the introduction of the refrigerant into the second evaporator 250 is restricted, and a cooling operation of the refrigerator compartment 20 is performed by supplying the refrigerant to the first evaporator 210. According to such an action, the cooling operation of the refrigerator compartment 20 may be performed even when a defrosting operation of the second evaporator 250 is performed, and thus degradation in cooling performance of the refrigerator 10*b* may be reduced or prevented.

The refrigerant passed through the first evaporator 210 is suctioned into the second compressor 201*b*, and then compressed. The refrigerant compressed in the second compressor 201*b* may pass through the condenser 202.

When the refrigerator 10*b* is operated in a refrigerator compartment defrosting mode that is a third mode, the second valve 230 may be operated in a predetermined operation mode, and the first evaporator 210 may naturally perform the defrosting operation. When the two compressors 201*a* and 201*b* perform a compressing operation in two stages, an evaporation temperature of the first evaporator 210 disposed at a high pressure side may be relatively higher. For example, the evaporation temperature of the first evaporator 210 may be formed within a range of −5° C. to 0° C. Therefore, an ice forming amount of the first evaporator 210 may be relatively small, and a frosting degree may not be as serious.

Therefore, instead of the separate high temperature refrigerant (hot gas), the cooling air in the refrigerator compartment 20 may be supplied to the first evaporator 210, and may perform the defrosting operation of the first evaporator 210.

Specifically, in the refrigerator compartment defrosting mode of the refrigerator 10*b*, the refrigerant compressed in the first and second compressors 201*a* and 201*b* passes through the condenser 202, and is introduced into the second valve 230. The second valve 230 may be controlled in the third operation mode. Specifically, the first inlet and outlet part 231 and the second inlet and outlet part 232 of the second valve 230 are connected, and the third inlet and outlet part 233 and the fourth inlet and outlet part 234 are connected. Therefore, the refrigerant passed through the condenser 202 is introduced into the second valve 230 through the first inlet and outlet part 231, and discharged from the second valve 230 through the second inlet and outlet part 232. And the flow of the refrigerant through the hot gas path 205 is restricted.

The refrigerant discharged from the second valve 230 is introduced into the first valve 220. The first valve 220 is operated so that the refrigerant flows to the second evaporator 250. Therefore, the refrigerant may flow to the second refrigerant path 204 through the first valve 220, and may be evaporated in the second evaporator 250. The cooling air generated at the second evaporator 250 may cool the freezer compartment 30.

The flow of the refrigerant may not be performed in the first refrigerant path 203 and the first evaporator 210. However, the first evaporation fan 210*a* is driven, and thus the cooling air in the refrigerator compartment 20 is circulated through the first evaporator 210 and the refrigerator compartment 20. In this process, the defrosting operation of the first evaporator 210 is performed through the cooling air of the refrigerator compartment 20 which has a relatively high temperature (natural defrosting).

According to such an action, the cooling operation of the freezer compartment 30 may be performed even when the defrosting operation of the first evaporator 210 is performed, and thus degradation in cooling performance of the refrigerator 10*b* may be reduced or prevented. And in comparison with the defrosting operation using the hot gas, the temperature of the first evaporator 210 may be kept relatively low through the natural defrosting operation, and thus when the first evaporator 210 is operated after the defrosting operation is terminated, evaporation performance may be improved.

Since the defrosting of the evaporator can be performed using the high temperature refrigerant (or the hot gas), it may not be necessary to install the conventional defrosting heater, and thus it is possible to reduce the cost.

In particular, the high temperature refrigerant discharged from the compressor or the high temperature refrigerant condensed in the condenser can flow to one evaporator to be defrosted, can perform the defrosting operation, can be condensed while the defrosting operation is performed, and then can be evaporated in the other evaporator, and thus the storage compartment in which the other evaporator is installed can be cooled.

For example, when the freezer compartment evaporator is defrosted, the refrigerator compartment evaporator is driven, and thus the cooling operation of the refrigerator compartment can be performed, and when the refrigerator compartment evaporator is defrosted, the freezer compartment evaporator is driven, and thus the cooling operation of the freezer compartment can be performed. In this case, the refrigerant can flow to the refrigerator compartment evaporator in which the defrosting operation is performed, and the condensing temperature can be lowered, and also the refrigerant is evaporated in the freezer compartment evaporator after condensation, and thus cooling efficiency in the freezer compartment evaporator can be improved.

Also, the evaporator may include the first pipe through which the refrigerant to be evaporated flows, the second pipe through which the high temperature refrigerant flows, and the fin that is coupled to the first and second pipes. Thus, in the defrosting operation, the ice formed on the evaporator may be removed using the high temperature refrigerant, and thus defrosting efficiency can be improved.

That is, in comparison with devices in which the defrosting of the evaporator is performed in a convection current method or a radiant method using the defrosting heater, the heat of the high temperature refrigerant can be transferred to the evaporator in a heat conduction method, and the defrosting efficiency may be improved. Thus the defrosting time may become shorter, and a temperature of the storage compartment may be prevented from being excessively increased during the defrosting operation.

Even though all the elements of the implementations are coupled into one or operated in the combined state, the present disclosure is not limited to such an implementation. That is, all the elements may be selectively combined with each other without departing from the scope of the disclosure.

Although implementations have been described with reference to a number of illustrative implementations thereof, it will be understood by those skilled in the art that various changes in form and details may be made therein without departing from the spirit and scope of the disclosure as defined by the appended claims.

What is claimed is:

1. A refrigerator comprising:

a compressor configured to compress a refrigerant;

a condenser configured to condense the refrigerant compressed in the compressor;

at least one expander configured to depressurize the refrigerant condensed in the condenser;

a first evaporator and a second evaporator that are configured to evaporate the refrigerant depressurized in the at least one expander;

a three-way valve disposed at an outlet side of the condenser and configured to be operated to introduce the refrigerant condensed by the condenser into at least one of the first evaporator or the second evaporator, the three-way valve including an inlet connected to an outlet pipe of the condenser, a first outlet connected to the first evaporator, and a second outlet connected to the first evaporator;

a first refrigerant path that extends from the first outlet of the three-way valve to the first evaporator;

a second refrigerant path that extends from the second outlet of the three-way valve to the second evaporator;

a first four-way valve provided in the outlet pipe of the condenser, the first four-way valve including a first port configured to receive refrigerant passing through the condenser, a second port, a third port, and a fourth port;

a second four-way valve provided in the outlet pipe of the condenser, the second four-way valve including a first port connected to the second port of the first four-way valve, a second port connected to the inlet of the three-way valve, a third port, and a fourth port;

a first hot gas path that extends from the first four-way valve to the first evaporator, the first hot gas path defining a first closed loop that passes through the first four-way valve and the first evaporator; and a second hot gas path that extends from the second four-way valve to the second evaporator, the second hot gas path defining a second closed loop that passes through the second four-way valve and the second evaporator, wherein the first evaporator comprises a first pipe that communicates with the first refrigerant path and a second pipe that communicates with the first hot gas path, and the second evaporator comprises a first pipe that communicates with the second refrigerant path and a second pipe that communicates with the second hot gas path, and wherein the third and fourth ports of the first four-way valve are configured to communicate with the first hot gas path, and the third and fourth ports of the second four-way valve are configured to communicate with the second hot gas path.

2. The refrigerator according to claim 1, wherein the at least one expander comprises:

a first expander installed in the first refrigerant path, and a second expander installed in the second refrigerant path.

3. The refrigerator according to claim 2, wherein, based on the refrigerator being operated in a first mode of operation, the three-way valve is configured to operate such that the refrigerant flows to at least one of the first evaporator or the second evaporator, and the first four-way valve and the second four-way valve are configured to operate to restrict a flow of the refrigerant to the first hot gas path and the second hot gas path, respectively.

4. The refrigerator according to claim 2, wherein, based on the refrigerator being operated in a second mode of operation, the three-way valve is configured to operate such that the refrigerant flows to the first evaporator, and the first four-way valve is configured to operate to restrict a flow of the refrigerant to the first hot gas path, and the second four-way valve is configured to operate to guide the flow of the refrigerant to the second hot gas path.

5. The refrigerator according to claim 2, wherein, based on the refrigerator being operated in a third mode of operation, the three-way valve is configured to operate such that the refrigerant flows to the second evaporator, and the first four-way valve is configured to operate to guide a flow of the refrigerant to the first hot gas path, and the second four-way valve is configured to operate to restrict the flow of the refrigerant to the second hot gas path.

* * * * *